US012344810B2

(12) United States Patent
Takahara Niiya et al.

(10) Patent No.: US 12,344,810 B2
(45) Date of Patent: Jul. 1, 2025

(54) GREASE COMPOSITION AND PRODUCTION METHOD OF GREASE COMPOSITION

(71) Applicant: JTEKT CORPORATION, Kariya (JP)

(72) Inventors: Kanako Takahara Niiya, Yao (JP); Junya Matsuyama, Nagoya (JP)

(73) Assignee: JTEKT CORPORATION, Kariya (JP)

( * ) Notice: Subject to any disclaimer, the term of this patent is extended or adjusted under 35 U.S.C. 154(b) by 0 days.

(21) Appl. No.: 18/579,569

(22) PCT Filed: Jun. 29, 2022

(86) PCT No.: PCT/JP2022/025934
§ 371 (c)(1),
(2) Date: Jan. 16, 2024

(87) PCT Pub. No.: WO2023/002820
PCT Pub. Date: Jan. 26, 2023

(65) Prior Publication Data

US 2024/0327742 A1 Oct. 3, 2024

(30) Foreign Application Priority Data

Jul. 21, 2021 (WO) ..... PCT/JP2021/027389

(51) Int. Cl.
*C10M 169/00* (2006.01)
*C10M 105/68* (2006.01)
(Continued)

(52) U.S. Cl.
CPC ..... *C10M 105/68* (2013.01); *C10M 119/02* (2013.01); *C10M 123/04* (2013.01);
(Continued)

(58) Field of Classification Search
CPC ..... C10M 105/68; C10M 119/02; C10M 123/04; C10M 2205/046;
(Continued)

(56) References Cited

U.S. PATENT DOCUMENTS 5,207,935 A 5/1993 Waynick
5,314,982 A 5/1994 Rasp et al.
(Continued)

FOREIGN PATENT DOCUMENTS

JP H05-209183 A 8/1993
JP 08337790 A * 12/1996
(Continued)

OTHER PUBLICATIONS

Aug. 23, 2022 Search Report issued in International Patent Application No. PCT/JP2022/025934.
(Continued)

*Primary Examiner* — Taiwo Oladapo
(74) *Attorney, Agent, or Firm* — Oliff PLC

(57) ABSTRACT

A grease composition includes a base oil and a thickener. The thickener contains a urea compound and a styrene-based polymer. A content of the styrene-based polymer is 2% by mass or more and 30% by mass or less as to a total amount of the urea compound and the styrene-based polymer. In the thickener, an average value of diameter of particles with a diameter of 0.2 μm or more is 0.2 μm or more and 1.0 μm or less.

1 Claim, 12 Drawing Sheets

(51) Int. Cl.

| | |
|---|---|
| ***C10M 119/02*** | (2006.01) |
| ***C10M 123/04*** | (2006.01) |
| ***C10M 169/06*** | (2006.01) |
| *C10N 20/06* | (2006.01) |
| *C10N 50/10* | (2006.01) |
| *C10N 70/00* | (2006.01) |

(52) U.S. Cl.
CPC .... *C10M 169/06* (2013.01); *C10M 2205/046* (2013.01); *C10M 2215/1026* (2013.01); *C10N 2020/06* (2013.01); *C10N 2050/10* (2013.01); *C10N 2070/00* (2013.01)

(58) Field of Classification Search
CPC ..... C10M 2215/1026; C10M 2205/04; C10M 2217/0456; C10M 105/04; C10M 115/08; C10M 169/06; C10M 107/02; C10N 2020/06; C10N 2050/10; C10N 2070/00; C10N 2040/02
See application file for complete search history.

(56) References Cited

U.S. PATENT DOCUMENTS

| | | | |
|---|---|---|---|
| 2012/0214721 | A1 | 8/2012 | Ikuma et al. |
| 2015/0030275 | A1 | 1/2015 | Tsuna |
| 2018/0273871 | A1 | 9/2018 | Hishinuma et al. |
| 2020/0148970 | A1 | 5/2020 | Watanabe |
| 2022/0145203 | A1 | 5/2022 | Watanabe |

FOREIGN PATENT DOCUMENTS

| | | | | |
|---|---|---|---|---|
| JP | 2002327188 | A | * | 11/2002 |
| JP | 2004339447 | A | * | 12/2004 |
| JP | 2007-297422 | A | | 11/2007 |
| JP | 2012-177105 | A | | 9/2012 |
| JP | 2013-227438 | A | | 11/2013 |
| JP | 2015-021117 | A | | 2/2015 |
| JP | 2015-193858 | A | | 11/2015 |
| JP | 2020-105350 | A | | 7/2020 |
| KR | 20060050393 | A | * | 5/2006 |
| WO | 2017/094602 | A1 | | 6/2017 |
| WO | 2019/017227 | A1 | | 1/2019 |
| WO | 2019/151332 | A1 | | 8/2019 |
| WO | 2020/179589 | A1 | | 9/2020 |

OTHER PUBLICATIONS

May 6, 2024 extended Search Report issued in European Patent Application No. 22845756.0.

* cited by examiner

GREASE COMPOSITION AND PRODUCTION METHOD OF GREASE COMPOSITION

This application claims priority based on the international patent application PCT/JP2021/027389 filed on Jul. 21, 2021, and incorporates all contents described in the above international patent application.

TECHNICAL FIELD

The present disclosure relates to a grease composition and a production method of the grease composition.

BACKGROUND ART

Grease compositions are used to lubricate sliding parts such as rolling bearings, gears, and so forth.

Patent Documents 1 to 7 describe grease compositions.

RELATED ART DOCUMENTS

Patent Documents

Patent Document 1: Japanese Unexamined Patent Application Publication No. 2015-193858 (JP 2015-193858 A)
Patent Document 2: Japanese Unexamined Patent Application Publication No. 2013-227438 (JP 2013-227438 A)
Patent Document 3: Japanese Unexamined Patent Application Publication No. 2012-177105 (JP 2012-177105 A)
Patent Document 4: Japanese Unexamined Patent Application Publication No. 2007-297422 (JP 2007-297422 A)
Patent Document 5: U.S. Pat. No. 5,207,935
Patent Document 6: Japanese Unexamined Patent Application Publication No. 2002-327188 (JP 2002-327188 A)
Patent Document 7: WO 2019/017227

SUMMARY OF THE INVENTION

Problem to be Solved by the Invention

Grease compositions used for lubrication of rolling bearings, gears, and so forth, are required to have good oil retention properties in order to ensure good lubrication. Also, in order to meet needs for energy conservation and high efficiency of rolling bearings, gears, and so forth, the above-mentioned grease compositions are required to be capable of reducing torque.

That is to say, there is demand for a grease composition that has good oil retention properties and can also ensure low torque properties when used with rolling bearings, gears, and the like.

Means for Solving the Problem

A grease composition according to one aspect of the present disclosure includes a base oil and a thickener. The thickener contains a urea compound and a styrene-based polymer, in which a content of the styrene-based polymer is 2% by mass or more and 30% by mass or less as to a total amount of the urea compound and the styrene-based polymer.

Particles of the thickener that have diameters of 0.2 μm or more have an average value of diameter of 0.2 μm or more and 1.0 μm or less.

A production method of a grease composition according to another aspect of the present disclosure includes providing a styrene-based polymer, an amine compound, an isocyanate compound, a lubricating oil, a first solvent that does not dissolve a urea compound that is generated, and a second solvent that does not dissolve the urea compound that is generated, dissolving or dispersing the amine compound in the first solvent, dissolving or dispersing the isocyanate compound in the second solvent, dissolving or dispersing the styrene-based polymer in one or both of the first solvent and the second solvent, such that a first blended solution containing at least the amine compound and a second blended solution containing at least the isocyanate compound are prepared, blending the first blended solution and the second blended solution, and carrying out reaction of the amine compound and the isocyanate compound, such that a third blended solution containing the styrene-based polymer and the urea compound is generated, and adding the lubricating oil after removing the first solvent and the second solvent from the third blended solution.

A production method of a grease composition according to another aspect of the present disclosure includes providing a styrene-based polymer, an amine compound, an isocyanate compound, a first lubricating oil, and a second lubricating oil, dissolving or dispersing the amine compound in the first lubricating oil, dissolving or dispersing the isocyanate compound in the second lubricating oil, dissolving or dispersing the styrene-based polymer in one or both of the first lubricating oil and the second lubricating oil, such that a fourth blended solution containing at least the amine compound and a fifth blended solution containing at least the isocyanate compound are prepared, and blending the fourth blended solution and the fifth blended solution, and carrying out reaction of the amine compound and the isocyanate compound.

Effects of the Invention

The grease composition according to the present disclosure has excellent oil retention properties.

The grease composition according to the present disclosure can ensure low torque properties when used with rolling bearings, gears, and the like.

According to the production method of the grease composition according to the present disclosure, the grease composition of the present disclosure can be suitably produced.

MODES FOR CARRYING OUT THE INVENTION

Figure 1:
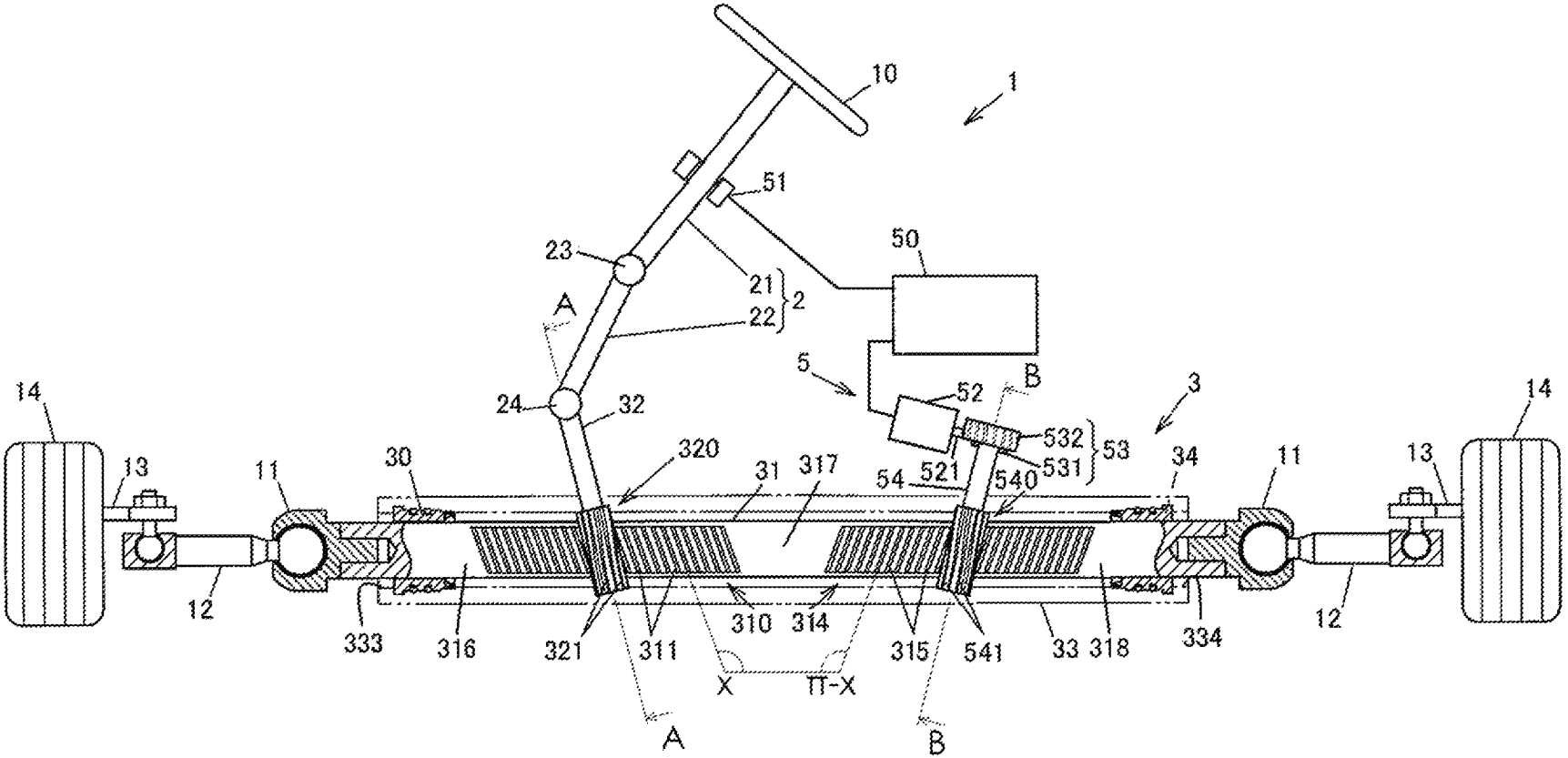
FIG. 1 is a configuration diagram schematically illustrating an example of a dual-pinion type electric power steering system in which a grease composition is sealed.

Overview of Embodiments of Invention According to Present Disclosure

Hereinafter, an outline of the embodiments of the invention of the present disclosure will be listed and described.

(1) A grease composition according to an embodiment of the present disclosure includes a base oil and a thickener, the thickener contains a urea compound and a styrene-based polymer, a content of the styrene-based polymer is 2% by mass or more and 30% by mass or less as to a total amount of the urea compound and the styrene-based polymer, and particles of the thickener that have diameters of 0.2 μm or more have an average value of diameter of 0.2 μm or more and 1.0 μm or less.

The above grease composition contains a urea compound and a predetermined amount of a styrene-based polymer as a thickener, and the particles of the thickener that have diameters of 0.2 μm or more have an average value of diameter of 0.2 μm or more and 1.0 μm or less. That is to say, the grease composition does not contain coarse thickener particles that tend to occur when the urea compound alone is contained therein. Accordingly, the above grease composition retains oil well. In other words, the above grease composition has good oil retention properties. Further, the above grease composition enables rolling bearings, gears, and so forth, to operate with low torque. In other words, the above grease composition has good low torque properties.

On the other hand, the above-mentioned Patent Documents 1 to 7 do not describe that both good oil retention properties and good low torque properties can be achieved through a thickener that contains a urea compound and a predetermined amount of a styrene-based polymer, in which the particles that have diameters of 0.2 μm or more have an average value of diameter of 0.2 μm or more and 1.0 μm or less.

(2) In the grease composition according to (1) above, the content of the styrene-based polymer may be 2% by mass or more and 9% by mass or less as to the total amount of the urea compound and the styrene-based polymer.

(3) In the grease composition according to (1) or (2) above, the urea compound is preferably diurea.

In this case, even when the grease composition is used at high temperatures, the grease composition does not readily deteriorate. In other words, the above grease composition has good heat resistance.

(4) In the grease composition according to any one of (1) to (3) above, the base oil is preferably poly-α-olefin.

In this case, the grease composition has excellent fluidity at low temperatures. In other words, the above grease composition has good low-temperature fluidity. Further, members such as members made of rubber or resin around rolling and sliding faces that require lubrication, such as rolling bearings, gears, and so forth, for example, are less likely to deteriorate. In other words, the grease composition exhibits little aggression with respect to members made of rubber or made of resin.

(5) In the grease composition according to any one of (1) to (4) above, a content of the thickener is preferably 10% by mass or more and 40% by mass or less as to a total amount of the base oil and the thickener.

In this case, the grease composition has even better low torque properties.

(6) In a production method of a grease composition according to an embodiment of the present disclosure, a styrene-based polymer, an amine compound, an isocyanate compound, a lubricating oil, a first solvent that does not dissolve a urea compound that is generated, and a second solvent that does not dissolve the urea compound that is generated, are provided, the amine compound and the styrene-based polymer are dissolved or dispersed in the first solvent, thereby preparing a first blended solution, the isocyanate compound and the styrene-based polymer are dissolved or dispersed in the second solvent, thereby preparing a second blended solution, the first blended solution and the second blended solution are blended and reaction of the amine compound and the isocyanate compound is carried out, such that a third blended solution containing the styrene-based polymer and the urea compound is generated, and the lubricating oil is added after removing the first solvent and the second solvent from the third blended solution.

(7) In a production method of a grease composition according to another embodiment of the present disclosure, a styrene-based polymer, an amine compound, an isocyanate compound, a lubricating oil, a first solvent that does not dissolve a urea compound that is generated, and a second solvent that does not dissolve the urea compound that is generated, are provided, the amine compound is dissolved or dispersed in the first solvent, thereby preparing a first blended solution, the isocyanate compound and the styrene-based polymer are dissolved or dispersed in the second solvent, thereby preparing a second blended solution, the first blended solution and the second blended solution are blended and reaction of the amine compound and the isocyanate compound is carried out, such that a third blended solution containing the styrene-based polymer and the urea compound is generated, and the lubricating oil is added after removing the first solvent and the second solvent from the third blended solution.

(8) In a production method of a grease composition according to another embodiment of the present disclosure, a styrene-based polymer, an amine compound, an isocyanate compound, a lubricating oil, a first solvent that does not dissolve a urea compound that is generated, and a second solvent that does not dissolve the urea compound that is generated, are provided, the amine compound and the styrene-based polymer are dissolved or dispersed in the first solvent, thereby preparing a first blended solution, the isocyanate compound is dissolved or dispersed in the second solvent, thereby preparing a second blended solution, the first blended solution and the second blended solution are blended and reaction of the amine compound and the isocyanate compound is carried out, such that a third blended solution containing the styrene-based polymer and the urea compound is generated, and the lubricating oil is added after removing the first solvent and the second solvent from the third blended solution.

(9) In a production method of a grease composition according to another embodiment of the present disclosure, a styrene-based polymer, an amine compound, an isocyanate compound, a first lubricating oil, and a second lubricating oil are provided, the amine compound and the styrene-based polymer are dissolved or dispersed in the first lubricating oil, thereby preparing a fourth blended solution, the isocyanate compound and the styrene-based polymer are dissolved or dispersed in the second lubricating oil, thereby preparing a fifth blended solution, the fourth blended solution and the fifth blended solution are blended, and reaction of the amine compound and the isocyanate compound is carried out.

(10) In a production method of a grease composition according to another embodiment of the present disclosure, a styrene-based polymer, an amine compound, an isocyanate compound, a first lubricating oil, and a second lubricating oil are provided, the amine compound is dissolved or dispersed in the first lubricating oil, thereby preparing a fourth blended solution, the isocyanate compound and the styrene-based polymer are dissolved or dispersed in the second lubricating oil, thereby preparing a fifth blended solution, the fourth blended solution and the fifth blended solution are blended, and reaction of the amine compound and the isocyanate compound is carried out.

(11) In a production method of a grease composition according to another embodiment of the present disclosure, a styrene-based polymer, an amine compound, an isocyanate compound, a first lubricating oil, and a second lubricating oil are provided, the amine compound and the styrene-based polymer are dissolved or dispersed in the first lubricating oil, thereby preparing a fourth blended solution, the isocyanate compound is dissolved or dispersed in the second lubricating oil, thereby preparing a fifth blended solution, the fourth blended solution and the fifth blended solution are blended, and reaction of the amine compound and the isocyanate compound is carried out.

According to these production methods of (6) to (11), the grease composition according to the embodiment of the present disclosure can be suitably produced.

Details of Embodiments of Invention According to Present Disclosure

Embodiments of the invention according to the present disclosure will be described below. Note that in the present disclosure, the embodiments of the invention should be understood to be exemplary in all respects and not restrictive. The scope of rights of the present invention is set forth in the claims, and is intended to include all modifications that fall within the meaning and scope equivalent to the claims.

First, a device and the like in which the grease composition according to the present disclosure is used will be described, following which embodiments regarding the grease composition according to the present disclosure will be described.

The grease composition according to the present disclosure is used in, for example, dual-pinion type electric power steering systems, column type electric power steering systems, rolling bearings, and so forth.

<<Dual-Pinion Type Electric Power Steering System>>

FIG. 1 is a configuration diagram schematically illustrating an example of a dual-pinion type electric power steering system 1 including a steering gear device 3.

Figure 2:
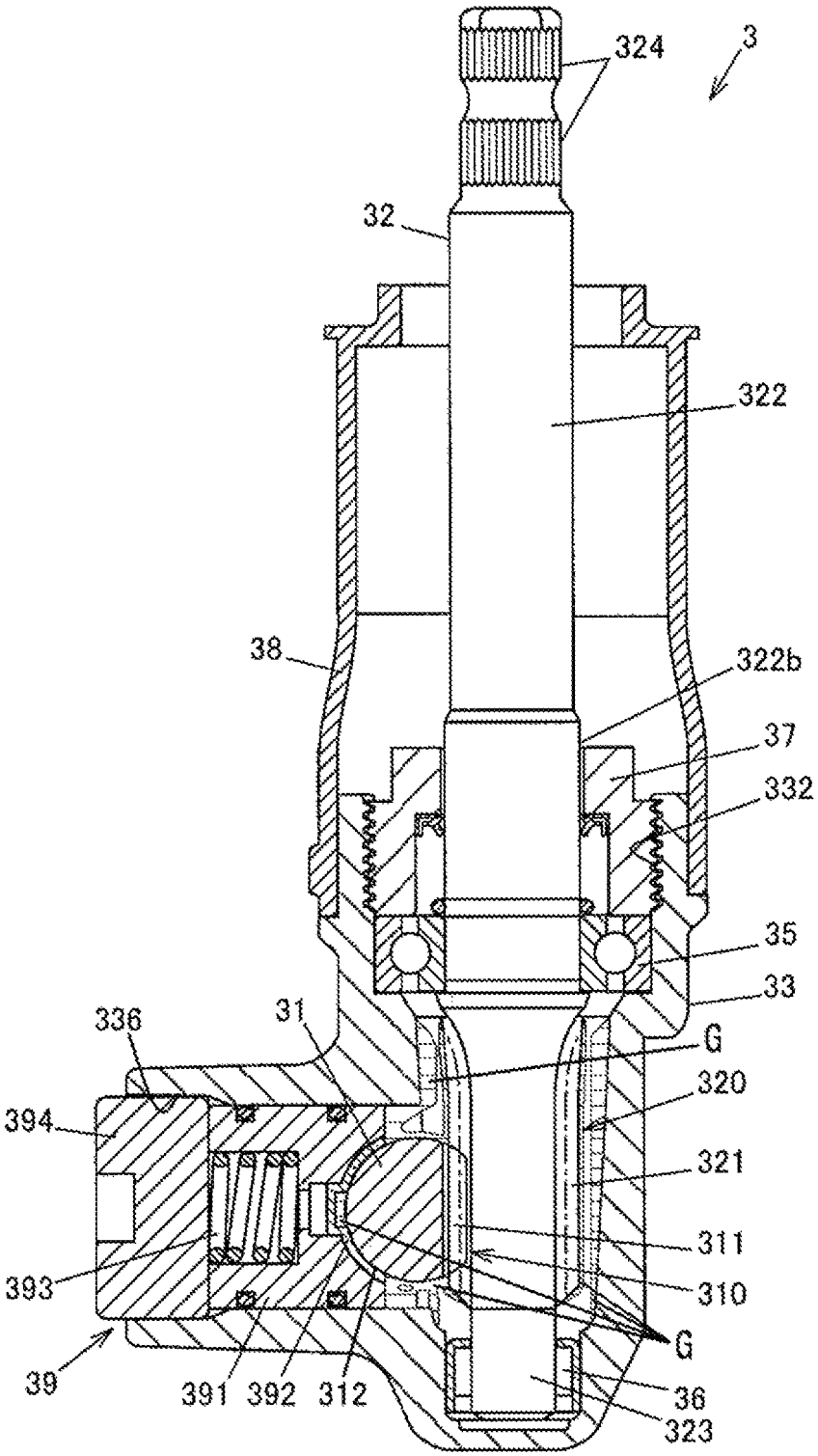
FIG. 2 is a sectional view taken along A-A in FIG. 1.

FIG. 2 is a sectional view taken along A-A in FIG. 1, illustrating a portion of the steering gear device 3. In FIG. 2, a lower side of the drawing corresponds to a lower side in a vertical direction when installed in a vehicle.

Figure 3:
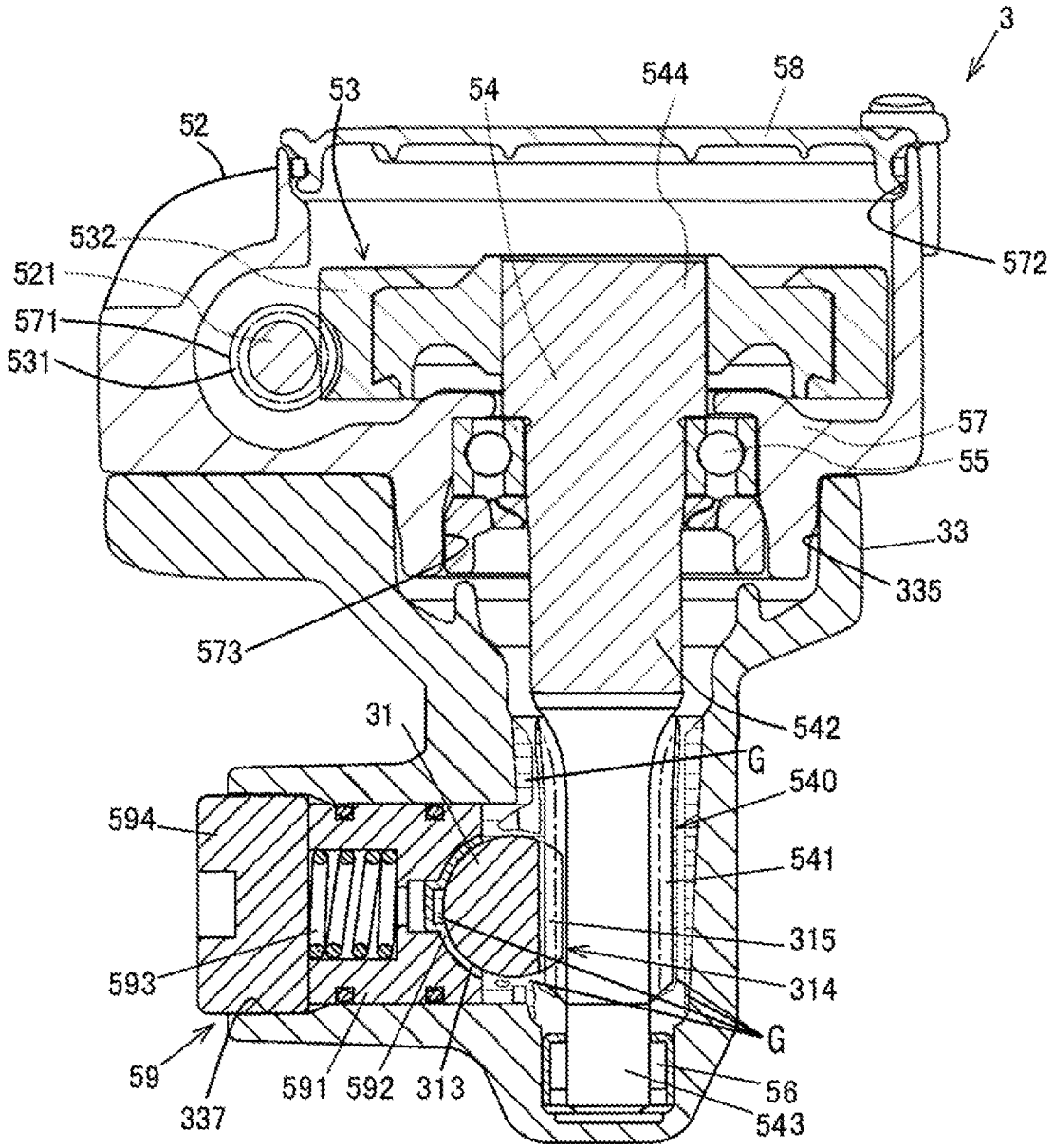
FIG. 3 is a sectional view taken along B-B in FIG. 1.

FIG. 3 is a sectional view taken along B-B in FIG. 1, illustrating a portion of the steering gear device 3. In FIG. 3, the lower side of the drawing corresponds to the lower side in the vertical direction when installed in the vehicle.

The dual-pinion type electric power steering system 1 includes a steering wheel 10, a steering shaft 2, a first pinion shaft 32, a rack shaft 31, a housing 33, two rack bushings 30 and 34, two bearings 35 and 36, a first rack guide mechanism 39, and a steering assistance device 5. The steering assistance device 5 includes a controller 50, a torque sensor 51, an electric motor 52, a speed reducing mechanism 53, a second pinion shaft 54, two bearings 55 and 56, a worm housing 57, and a second rack guide mechanism 59. The speed reducing mechanism 53 includes a worm 531 and a worm wheel 532.

A driver who drives an automobile equipped with this dual-pinion type electric power steering system 1 performs steering operations by turning the steering wheel 10. The steering shaft 2 includes a column shaft 21, a first universal joint 23, an intermediate shaft 22, and a second universal joint 24. The first universal joint 23 includes a first yoke that is omitted from illustration, a plurality of first rolling elements that is omitted from illustration, a first joint spider that is omitted from illustration, a plurality of second rolling elements that is omitted from illustration, and a second yoke that is omitted from illustration. The second universal joint 24 includes a third yoke that is omitted from illustration, a plurality of third rolling elements that is omitted from illustration, a second joint spider that is omitted from illustration, a plurality of fourth rolling elements that is omitted from illustration, and a fourth yoke that is omitted from illustration.

The column shaft 21 fixes the steering wheel 10 at one end thereof in an extending direction. The column shaft 21 fixes the first yoke of the first universal joint 23 at the other end thereof in the extending direction. The column shaft 21 is rotatable about a central axis in the extending direction. The first yoke is pivotably fitted to a first pair of trunnions located on the same central axis of the first joint spider via the plurality of first rolling elements. The second yoke is pivotably fitted to a second pair of trunnions located on the same central axis of the first joint spider via the plurality of second rolling elements. The central axes of the first pair of trunnions and the central axes of the second trunnions intersect at an angle of 90 degrees.

The second yoke of the first universal joint 23 fixes one end of the intermediate shaft 22 in the extending direction thereof. The intermediate shaft 22 fixes the third yoke of the second universal joint 24 at the other end thereof in the extending direction. The third yoke is pivotably fitted to a third pair of trunnions located on the same central axis of the second joint spider via the plurality of third rolling elements. The fourth yoke is pivotably fitted to a fourth pair of trunnions located on the same central axis of the second joint spider via the plurality of fourth rolling elements. The central axes of the third pair of trunnions and the central axes of the fourth trunnions intersect at an angle of 90 degrees. The fourth yoke of the second universal joint 24 fixes one end of the first pinion shaft 32 in the extending direction thereof. Thus, when the driver turns the steering wheel 10, the column shaft 21 turns about the central axis thereof in the extending direction thereof, the intermediate shaft 22 also turns about a central axis thereof in the extending direction thereof, and the first pinion shaft 32 also turns about a central axis thereof in the extending direction thereof.

In the dual-pinion type electric power steering system 1, the first pinion shaft 32, the rack shaft 31, the housing 33, the two rack bushings 30 and 34, a first bearing 35, a second bearing 36, the first rack guide mechanism 39, the electric motor 52, the speed reducing mechanism 53, the second pinion shaft 54, a third bearing 55, a fourth bearing 56, the worm housing 57, and the second rack guide mechanism 59 make up the steering gear device 3 that serves as a rack and pinion type steering device. In FIG. 1, the housing 33 is represented by a hidden outline (long dashed double-short dashed lines), and inside thereof is illustrated.

The first pinion shaft 32 extends from an upper side toward the lower side of the automobile in the vertical direction. The first pinion shaft 32 includes, from one end side toward the other end in the extending direction thereof, a serrated portion 324, a first shaft portion 322, a first pinion toothed portion 320, and a first boss portion 323. Serrations are formed in the serrated portion 324. The fourth yoke of the second universal joint 24 is fixed to the serrations of the serrated portion 324. The first shaft portion 322 has a cylindrical shape. First pinion teeth 321 are formed over the entire face of the first pinion toothed portion 320 in the circumferential direction. An extending direction of the first pinion teeth 321 has an angle that is not 90 degrees with respect to the extending direction of the central axis of the first pinion shaft 32. The first boss portion 323 has a cylindrical shape.

The housing 33 has a first opening 332 on a steering wheel 10 side thereof, and a side opposite to the first opening 332 is sealed off. The first pinion shaft 32 is accommodated within the housing 33. The first pinion shaft 32 is rotatably supported by the two bearings 35 and 36, with respect to the housing 33. The first bearing 35 is a ball bearing. The first bearing 35 includes an inner ring, an outer ring, and balls, with the inner ring being fixed to the first shaft portion 322 and also the outer ring being fixed to the housing 33, and the balls roll between the inner ring and the outer ring. The second bearing 36 is a roller bearing. The second bearing 36 includes rollers and an outer ring, with the outer ring being fixed to the housing 33, and the rollers roll on an outer peripheral face of the first boss portion 323 and the outer ring.

A lid 37, through which the first pinion shaft 32 passes in a state in which the first pinion shaft 32, the first bearing 35, and the second bearing 36 are inserted into the housing 33, is fixed to the first opening 332 of the housing. A seal is fixed to the lid 37, and the seal is slidable on an outer peripheral face 322*b* of the first shaft portion 322 of the first pinion shaft 32. A cover member 38 is further fixed to the housing 33. The cover member 38 covers a portion of the first shaft portion 322 of the first pinion shaft 32 from the outside, in a radial direction.

The rack shaft 31 is provided with, from one end to the other end in an extending direction thereof, a first cylindrical portion 316, a first rack toothed portion 310, a second cylindrical portion 317, a second rack toothed portion 314, and a third cylindrical portion 318. The first rack toothed portion 310 has first rack teeth 311 formed on a portion thereof in the circumferential direction, and the other portion thereof in the circumferential direction is a cylindrical face 312 of which a central axis is the extending direction of the rack shaft 31. The second rack toothed portion 314 has second rack teeth 315 formed on a portion thereof in the circumferential direction, and the other portion thereof in the circumferential direction is a cylindrical face 313 of which a central axis is the extending direction of the rack shaft 31. An outer peripheral face of the first cylindrical portion 316, an outer peripheral face of the second cylindrical portion 317, and an outer peripheral face of the third cylindrical portion 318 are each a cylindrical face of which the central axis is in the extending direction of the rack shaft 31. The extending direction of the first rack teeth 311 has an angle that is not 90 degrees with respect to the extending direction of the rack shaft. The extending direction of the second rack teeth 315 has an angle that is not 90 degrees with respect to the extending direction of the rack shaft 31. With the angle of the first rack teeth 311 with respect to the extending direction of the rack shaft 31 as X, the angle of the second rack teeth 315 with respect to the extending direction of the rack shaft 31 is x-X.

The housing 33 extends in a direction different from the first opening 332 on the steering wheel 10 side, and has a second opening 333 at one end in the extending direction and a third opening 334 at the other end thereof. The rack shaft 31 is accommodated within the housing 33, along the direction in which the housing 33 extends. The first cylindrical portion 316 that is at one end of the rack shaft 31 in the extending direction thereof protrudes from the second opening 333 at one end of the housing 33 in the extending direction thereof. The third cylindrical portion 318 at the other end of the rack shaft 31 in the extending direction thereof protrudes from the third opening 334 at the other end of the housing 33 in the extending direction thereof. The housing 33 has a fourth opening 335. The fourth opening 335 is located closer to the other end side in the extending direction of the housing than the first opening 332 is. The housing 33 further has a fifth opening 336 and a sixth opening 337. The fifth opening 336 is located at approximately the same position in the extending direction of the housing 33 as the first opening 332, in a direction perpendicular to the first opening 332, in a radial direction with the extending direction of the housing 33 as the central axis. The sixth opening 337 is located at approximately the same position in the extending direction of the housing 33 as the fourth opening 335, in a direction perpendicular to the fourth opening 335, in a radial direction with the extending direction of the housing 33 as the central axis.

A first rack bushing 30 is fixed to one end of the housing 33 in the extending direction. The first rack bushing 30 is fixed to the housing 33, adjacent to the second opening 333. The first rack bushing 30 is slidable on the outer peripheral face of the first cylindrical portion 316 of the rack shaft 31. A second rack bushing 34 is fixed to the other end of the housing 33 in the extending direction. The second rack bushing 34 is fixed to the housing 33, adjacent to the third opening 334. The second rack bushing 34 is slidable on the outer peripheral face of the third cylindrical portion 318 of the rack shaft 31.

The first pinion teeth 321 formed on the first pinion toothed portion 320 of the first pinion shaft 32, and the first rack teeth 311 formed on the first rack toothed portion 310 of the rack shaft 31 are capable of rolling-sliding contact via the grease composition G. The first pinion teeth 321 and the first rack teeth 311 are meshed with each other via the grease composition G. When the first pinion shaft 32 turns relative to the housing 33 about the central axis in the extending direction thereof, the rack shaft 31 moves in a linear direction relative to the housing 33 in the extending direction of the housing 33.

The first rack guide mechanism 39 is fixed to the housing 33. The first rack guide mechanism 39 is fixed to the fifth opening 336. The fifth opening 336 is at the cylindrical face 312 side that is the other portion of the first rack toothed portion 310 of the rack shaft 31 in the circumferential direction, at a position where the first pinion shaft 32 meshes with the rack shaft 31, in the extending direction of the housing 33.

The first rack guide mechanism 39 includes a first support yoke 391, a first sheet member 392, a first coil spring 393, and a first plug 394. The first sheet member 392 is interposed between the cylindrical face 312, which is the other portion of the first rack toothed portion 310 of the rack shaft 31 in the circumferential direction, and the cylindrical face of the first support yoke 391. The first sheet member 392 is fixed to the first support yoke 391. The first sheet member 392 and the cylindrical face 312, which is the other portion of the first rack toothed portion 310 of the rack shaft 31 in the circumferential direction, are capable of sliding contact via the grease composition G. The first plug 394 is fixed to the fifth opening 336 of the housing 33. The first plug 394 is in contact with one end of the first coil spring 393. The first support yoke 391 is in contact with the other end of the first coil spring 393. The first coil spring 393 is shorter than a free length thereof in a state in which the first plug 394 is fixed to the fifth opening 336. Thus, the first sheet member 392 is pressed against the rack shaft 31 with respect to the housing 33.

The second pinion shaft 54 extends from the upper side to the lower side of the automobile in the vertical direction. The second pinion shaft 54 includes, from one end side to the other end along the extending direction thereof, a fitting portion 544, a second shaft portion 542, a second pinion toothed portion 540, and a second boss portion 543. The fitting portion 544 has a cylindrical shape. The second shaft portion 542 has a cylindrical shape. Second pinion teeth 541 are formed over the entire face of the second pinion toothed portion 540 in the circumferential direction. An extending direction of the second pinion teeth 541 has an angle that is not 90 degrees with respect to the extending direction of the central axis of the second pinion shaft 54. The second boss portion 543 has a cylindrical shape.

The worm wheel 532 is fitted into the fitting portion 544. The worm 531 is fixed to an output shaft 521 of the electric motor 52. The electric motor 52 is fixed to the worm housing 57. The worm housing 57 has a seventh opening 571. The output shaft 521 of the electric motor 52 is disposed in internal space of the worm housing 57 via the seventh opening 571. The electric motor 52 is fixed to the worm housing 57 so as to close off the seventh opening 571 of the worm housing 57.

The worm 531 is disposed in internal space of the worm housing 57. The worm wheel 532 is disposed in the internal space of the worm housing 57. The worm housing 57 has an eighth opening 572 vertically upward, and an assembly of the second pinion shaft 54 and the worm wheel 532 is inserted into the internal space of the worm housing 57 from the eighth opening 572. The eighth opening is closed with a lid 58. The worm housing 57 has a ninth opening 573 on the opposite side from the eighth opening 572. A portion of the second shaft portion 542 of the second pinion shaft 54, the second pinion toothed portion 540, and the second boss portion 543 protrude from the ninth opening 573 of the worm housing 57.

The worm housing 57 is fixed to the housing 33. The ninth opening 573 of the worm housing 57 and the fourth opening 335 of the housing 33 communicate with each other to seal off the internal space from the external space.

The third bearing 55 is a ball bearing. The bearing 55 includes an inner ring, an outer ring, and balls, with the inner ring being fixed to the second shaft portion 542 and also the outer ring being fixed to the worm housing 57, and the balls roll between the inner ring and the outer ring. The bearing 56 is a roller bearing. The bearing 56 includes rollers and an outer ring, with the outer ring being fixed to the housing 33, and the rollers roll on an outer peripheral face of the second boss portion 543 and the outer ring.

The second pinion teeth 541 formed on the second pinion toothed portion 540 of the second pinion shaft 54, and the second rack teeth 315 formed on the second rack toothed portion 314 of the rack shaft 31 are capable of rolling-sliding contact via the grease composition G. The second pinion teeth 541 and the second rack teeth 315 are meshed with each other via the grease composition G. When the second pinion shaft 54 turns relative to the housing 33 about the central axis in the extending direction thereof, the rack shaft 31 moves in the linear direction relative to the housing 33 in the extending direction of the housing 33.

The second rack guide mechanism 59 is fixed to the housing 33. The second rack guide mechanism 59 is fixed to the sixth opening 337. The sixth opening 337 is at the cylindrical face 313 side that is the other portion of the second rack toothed portion 314 of the rack shaft 31 in the circumferential direction, at a position where the second pinion shaft 54 meshes with the rack shaft 31, in the extending direction of the housing 33.

The second rack guide mechanism 59 includes a second support yoke 591, a second sheet member 592, a second coil spring 593, and a second plug 594. The second sheet member 592 is interposed between the cylindrical face 313, which is the other portion of the second rack toothed portion 314 of the rack shaft 31 in the circumferential direction, and a cylindrical face of the second support yoke 591. The second sheet member 592 is fixed to the second support yoke 591. The second sheet member 592 and the cylindrical face 313, which is the other portion of the second rack toothed portion 314 of the rack shaft 31 in the circumferential direction, are capable of sliding contact via the grease composition G. The second plug 594 is fixed to the sixth opening 337 of the housing 33. The second plug 594 is in contact with one end of the second coil spring 593. The second support yoke 591 is in contact with the other end of the second coil spring 593. The second coil spring 593 is shorter than a free length thereof in a state in which the second plug 594 is fixed to the sixth opening 337. Thus, the second sheet member 592 is pressed against the rack shaft 31 with respect to the housing 33.

The torque sensor 51 detects steering torque applied by the driver to the steering wheel 10 through the column shaft 21. The speed reducing mechanism 53 is an assembly in which the worm 531 that rotates integrally with the output shaft 521 of the electric motor 52 and the worm wheel 532 that rotates integrally with the second pinion shaft 54 mesh with each other. A motor current is supplied to the electric motor 52 from the controller 50. The controller 50 controls the electric motor 52 based on the steering torque detected by the torque sensor 51, vehicle speed, and so forth, and transmits rotational force of the output shaft 521 of the electric motor 52, of which speed is reduced by the speed reducing mechanism 53, to the second pinion shaft 54. The rotational force of the second pinion shaft 54 is applied from the second pinion teeth 541 to the second rack teeth 315, as a steering assisting force.

The housing 33 is fixed to an automobile that is omitted from illustration, with the extending direction of the housing 33 aligned with a vehicle-width direction. Ball joint sockets 11, 11 are fixed to one end and the other end of the rack shaft 31, respectively, and tie rods 12, 12 connected to these ball joint sockets 11, 11, respectively, are connected to bearing rings of rolling bearings that rotatably support a right and left pair of front wheels 14, 14 via knuckle arms 13, 13. Moving the rack shaft 31 in the linear direction, in the extending direction of the housing 33, steers the right and left front wheels 14, 14, which are steered wheels.

The grease composition G is sealed within the housing 33. The grease composition G is interposed between rolling and sliding faces of the first pinion teeth 321 and rolling and sliding faces of the first rack teeth 311, which are in contact with each other when the first pinion teeth 321 and the first rack teeth 311 mesh with each other, thereby lubricating between the rolling and sliding faces of both. The grease composition G is interposed between a sliding face of the first sheet member 392 and a sliding face of the cylindrical face 312, which is the other portion of the first rack toothed portion 310 of the rack shaft 31 in the circumferential direction, where the first sheet member 392 and the rack shaft 31 come into contact by being pressed against each other, thereby lubricating between both sliding faces. The grease composition G is interposed between rolling and sliding faces of the second pinion teeth 541 and rolling and sliding faces of the second rack teeth 315, which are in contact with each other when the second pinion teeth 541 and the second rack teeth 315 mesh with each other, thereby lubricating between the rolling and sliding faces of both. The grease composition G is interposed between a sliding face of the second sheet member 592 and a sliding face of the cylindrical face 313, which is the other portion of the second rack toothed portion 314 of the rack shaft 31 in the circumferential direction, where the second sheet member 592 and the rack shaft 31 come into contact by being pressed against each other, thereby lubricating between both sliding faces.

The steering gear device 3 configured in this way has the grease composition according to the present disclosure sealed therein, as the grease composition G. The grease composition according to the present disclosure ensures oil retention properties, and accordingly the steering gear device 3 has good seizure resistance and wear resistance.

<<Column Type Electric Power Steering System>>

Figure 4:
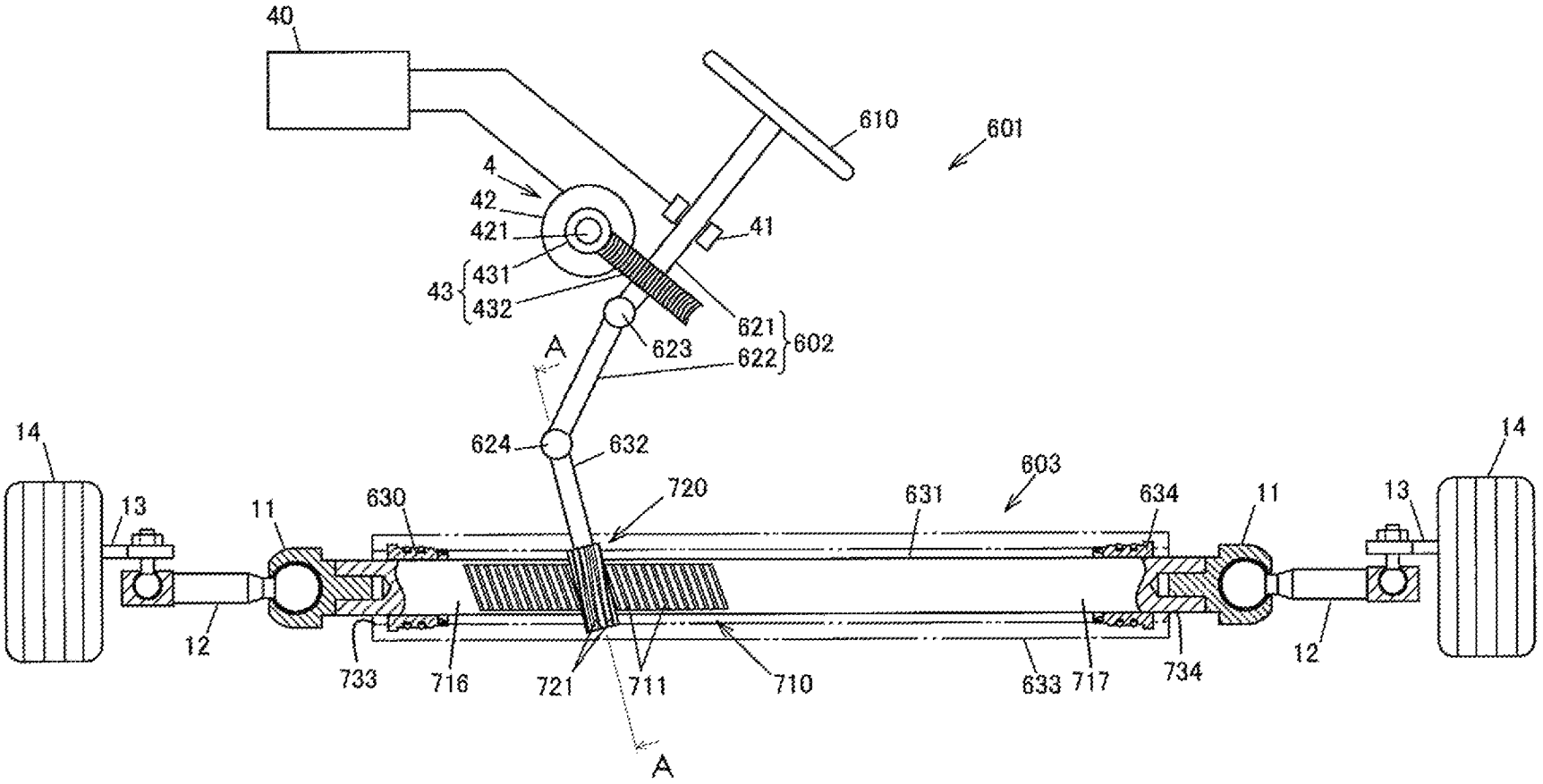
FIG. 4 is a configuration diagram schematically illustrating an example of a column type electric power steering system in which the grease composition is sealed.

FIG. 4 is a configuration diagram schematically illustrating an example of a column type electric power steering system 601 including a steering gear device 603.

Figure 5:
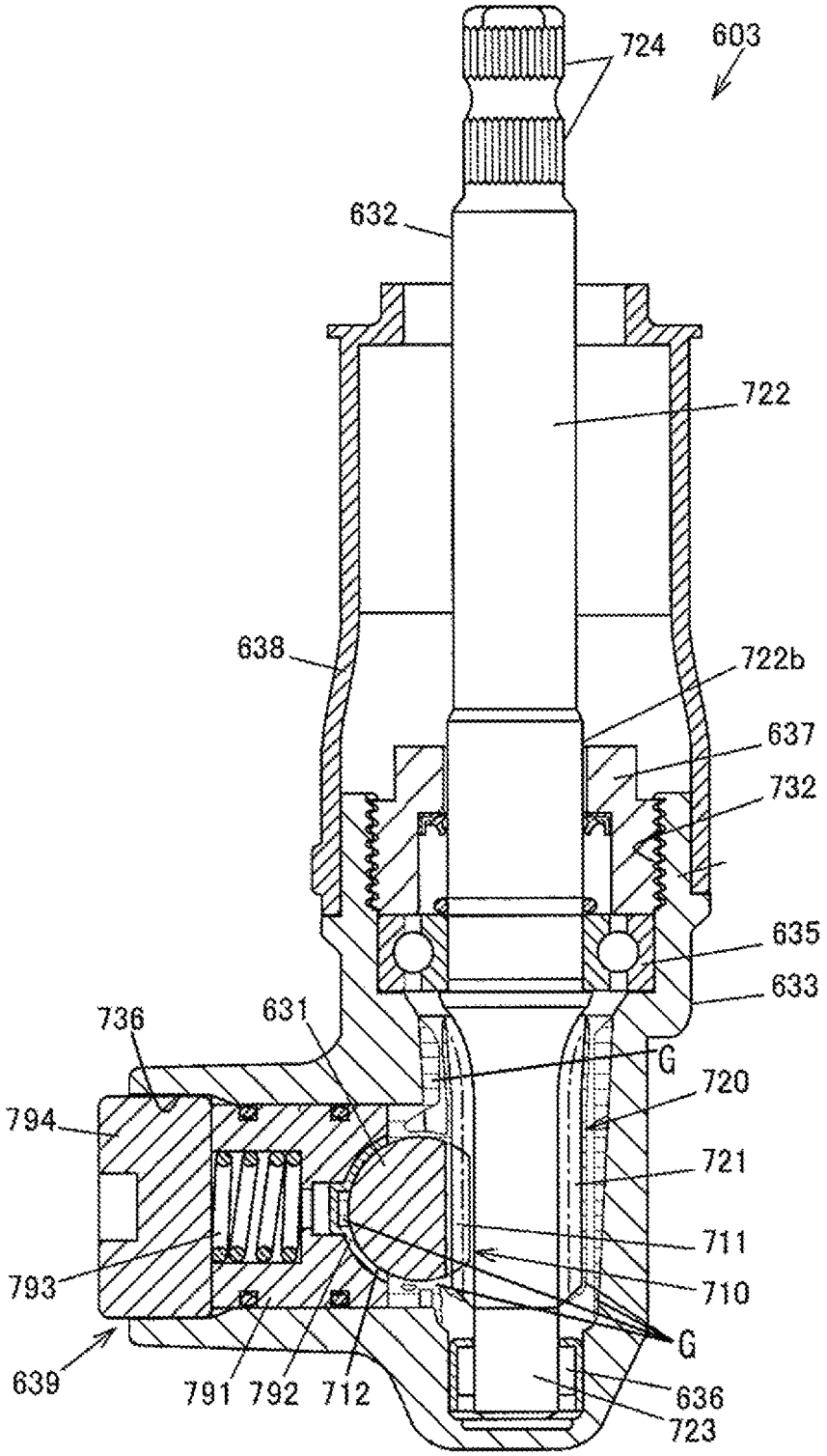
FIG. 5 is a sectional view taken along A-A in FIG. 4.

FIG. 5 is a sectional view taken along A-A in FIG. 4, illustrating a portion of the steering gear device 603. In FIG. 5, the lower side of the drawing corresponds to the lower side in the vertical direction when installed in a vehicle.

The column type electric power steering system 601 includes a steering wheel 610, a steering shaft 602, a pinion shaft 632, a rack shaft 631, a housing 633, two rack bushings 630 and 634, two bearings 635 and 636, a rack guide mechanism 639, and a steering assistance device 4. A driver who drives an automobile equipped with this column type electric power steering system 601 performs steering operations by turning the steering wheel 610. The steering shaft 602 includes a column shaft 621, a first universal joint 623, an intermediate shaft 622, and a second universal joint 624. The first universal joint 623 includes a first yoke that is omitted from illustration, a plurality of first rolling elements that is omitted from illustration, a first joint spider that is omitted from illustration, a plurality of second rolling elements that is omitted from illustration, and a second yoke that is omitted from illustration. The second universal joint 624 includes a third yoke that is omitted from illustration, a plurality of third rolling elements that is omitted from illustration, a second joint spider that is omitted from illustration, a plurality of fourth rolling elements that is omitted from illustration, and a fourth yoke that is omitted from illustration.

The column shaft 621 fixes the steering wheel 610 at one end thereof in the extending direction. The column shaft 621 fixes the first yoke of the first universal joint 623 at the other end thereof in the extending direction. The column shaft 621 is rotatable about a central axis in the extending direction. The first yoke is pivotably fitted to a first pair of trunnions located on the same central axis of the first joint spider via the plurality of first rolling elements. The second yoke is pivotably fitted to a second pair of trunnions located on the same central axis of the first joint spider via the plurality of second rolling elements. The central axes of the first pair of trunnions and the central axes of the second trunnions intersect at an angle of 90 degrees.

The second yoke of the first universal joint 623 fixes one end of the intermediate shaft 622 in the extending direction thereof. The intermediate shaft 622 fixes the third yoke of the second universal joint 624 at the other end thereof in the extending direction. The third yoke is pivotably fitted to a third pair of trunnions located on the same central axis of the second joint spider via the plurality of third rolling elements. The fourth yoke is pivotably fitted to a fourth pair of trunnions located on the same central axis of the second joint spider via the plurality of fourth rolling elements. The central axes of the third pair of trunnions and the central axes of the fourth trunnions intersect at an angle of 90 degrees. The fourth yoke of the second universal joint 624 fixes one end of the pinion shaft 632 in the extending direction thereof. Thus, when the driver turns the steering wheel 610, the column shaft 621 turns about the central axis in the extending direction thereof, the intermediate shaft 622 also turns about a central axis in the extending direction thereof, and the pinion shaft 632 also turns about a central axis in the extending direction thereof.

In the column type electric power steering system 601, the pinion shaft 632, the rack shaft 631, the housing 633, the two rack bushings 630 and 634, the two bearings 635 and 636, and the rack guide mechanism 639 make up the steering gear device 603 serving as a rack and pinion type steering device. In FIG. 4, the housing 633 is represented by a hidden outline (long dashed double-short dashed line), and inside thereof is illustrated.

The pinion shaft 632 extends from the upper side to the lower side of the automobile in the vertical direction. The pinion shaft 632 includes, from one end side to the other end along the extending direction thereof, a serrated portion 724, a shaft portion 722, a pinion toothed portion 720, and a boss portion 723. Serrations are formed in the serrated portion 724. The fourth yoke of the second universal joint 624 is fixed to the serrations of the serrated portion 724. The shaft portion 722 has a cylindrical shape. Pinion teeth 721 are formed over the entire face of the pinion toothed portion 720 in the circumferential direction. An extending direction of the pinion teeth 721 has an angle that is not 90 degrees with respect to the extending direction of the central axis of the pinion shaft 632. The boss portion 723 has a cylindrical shape.

The housing 633 has a first opening 732 on a steering wheel 610 side thereof, and a side opposite to the first opening 732 is sealed off. The pinion shaft 632 is accommodated within the housing 633. The pinion shaft 632 is rotatably supported by the two bearings 635 and 636, with respect to the housing 633. The bearing 635 is a ball bearing. The bearing 635 includes an inner ring, an outer ring, and balls, with the inner ring being fixed to the shaft portion 722 and also the outer ring being fixed to the housing 633, and the balls roll between the inner ring and the outer ring. The bearing 636 is a roller bearing. The bearing 636 includes rollers and an outer ring, with the outer ring being fixed to the housing 633, and the rollers roll on an outer peripheral face of the boss portion 723 and the outer ring.

A lid 637, through which the pinion shaft 632 passes in a state in which the pinion shaft 632, the two bearings 635 and 636 are inserted into the housing 633, is fixed to the first opening 732 of the housing. A seal is fixed to the lid 637, and the seal is slidable on an outer peripheral face 722*b* of the shaft portion 722 of the pinion shaft 632. A cover member 638 is further fixed to the housing 633. The cover member 638 covers a portion of the shaft portion 722 of the pinion shaft 632 from the outside, in the radial direction.

The rack shaft 631 is provided with, from one end to the other end in an extending direction thereof, a first cylindrical portion 716, a rack toothed portion 710, and a second cylindrical portion 717. The rack toothed portion 710 has rack teeth 711 formed on a portion thereof in the circumferential direction, and the other portion thereof in the circumferential direction is a cylindrical face 712 of which a central axis is the extending direction of the rack shaft 631. An outer peripheral face of the first cylindrical portion 716 and an outer peripheral face of the second cylindrical portion 717 are each a cylindrical face of which the central axis are in the extending direction of the rack shaft 631. The extending direction of the rack teeth 711 has an angle that is not 90 degrees with respect to the extending direction of the rack shaft 631.

The housing 633 extends in a direction different from the first opening 732 on the steering wheel 610 side, and has a second opening 733 at one end in the extending direction and a third opening 734 at the other end thereof. The rack shaft 631 is accommodated within the housing 633, along the direction in which the housing 633 extends. One end of the rack shaft 631 in the extending direction thereof protrudes from the second opening 733 at one end of the housing 633 in the extending direction thereof. The other end of the rack shaft 631 in the extending direction thereof protrudes from the third opening 734 at the other end of the housing 633 in the extending direction thereof.

The first rack bushing 630 is fixed to one end of the housing 633 in the extending direction. The first rack bushing 630 is fixed to the housing 633, adjacent to the second opening 733. The first rack bushing 630 is slidable on the outer peripheral face of the first cylindrical portion 716 of the rack shaft 631. A second rack bushing 634 is fixed to the other end of the housing 633 in the extending direction. The second rack bushing 634 is fixed to the housing 633, adjacent to the third opening 734. The second rack bushing 634 is slidable on the outer peripheral face of the second cylindrical portion 717 of the rack shaft 631.

The pinion teeth 721 formed on the pinion toothed portion 720 of the pinion shaft 632, and the rack teeth 711 formed on the rack toothed portion 710 of the rack shaft 631 are capable of rolling-sliding contact via the grease composition G. The pinion teeth 721 and the rack teeth 711 are meshed with each other via the grease composition G. When the pinion shaft 632 turns relative to the housing 633 about the central axis in the extending direction thereof, the rack shaft 631 moves in the linear direction relative to the housing 633 in the extending direction of the housing 633.

The housing 633 is fixed to an automobile that is omitted from illustration, with the extending direction of the housing 633 aligned with a vehicle-width direction. Ball joint sockets 11, 11 are fixed to one end and the other end of the rack shaft 631, respectively, and tie rods 12, 12 connected to these ball joint sockets 11, 11, respectively, are connected to bearing rings of rolling bearings that rotatably support a right and left pair of front wheels 14, 14 via knuckle arms 13, 13. Moving the rack shaft 631 in a linear direction, in the extending direction of the housing 633, steers the right and left front wheels 14, 14, which are steered wheels.

The rack guide mechanism 639 is fixed to the housing 633. The housing 633 has a fourth opening 736 at a cylindrical face 712 side that is the other portion of the rack toothed portion 710 of the rack shaft 631 in the circumferential direction, at a position where the pinion shaft 632 meshes with the rack shaft 631, in the extending direction.

The rack guide mechanism 639 includes a support yoke 791, a sheet member 792, a coil spring 793, and a plug 794. The sheet member 792 is interposed between the cylindrical face 712, which is the other portion of the rack toothed portion 710 of the rack shaft 631 in the circumferential direction, and a cylindrical face of the support yoke 791. The sheet member 792 is fixed to the support yoke 791. The sheet member 792 and the cylindrical face 712, which is the other portion of the rack toothed portion 710 of the rack shaft 631 in the circumferential direction, are capable of sliding contact via the grease composition G. The plug 794 is fixed to the fourth opening 736 of the housing 633. The plug 794 is in contact with one end of the coil spring 793. The support yoke 791 is in contact with the other end of the coil spring 793. The coil spring 793 is shorter than a free length thereof in a state in which the plug 794 is fixed to the fourth opening 736. Thus, the sheet member 792 is pressed against the rack shaft 631 with respect to the housing 633.

The steering assistance device 4 includes a controller 40, a torque sensor 41 that detects steering torque applied by the driver to the steering wheel 610, an electric motor 42, and speed reducing mechanism 43 that reduces the rotational force of the output shaft 421 of the electric motor 42 and performs transmission thereof to the column shaft 621. The speed reducing mechanism 43 is an assembly in which a worm 431 that rotates integrally with the output shaft 421 of the electric motor 42 and a worm wheel 432 that rotates integrally with the column shaft 621 mesh with each other. A motor current is supplied to the electric motor 42 from the controller 40. The controller 40 controls the electric motor 42 based on the steering torque detected by the torque sensor 41, vehicle speed, and so forth, and applies the rotational force of the output shaft 421 of the electric motor 42, of which speed is reduced by the speed reducing mechanism 43, to the column shaft 621 as a steering assisting force.

The grease composition G is sealed within the housing 633. The grease composition G is interposed between rolling and sliding faces of the pinion teeth 721 and rolling and sliding faces of the rack teeth 711, which are in contact with each other when the pinion teeth 721 and the rack teeth 711 mesh with each other, thereby lubricating between the rolling and sliding faces of both. The grease composition G is interposed between a sliding face of the sheet member 792 and a sliding face of the cylindrical face 712, which is the other portion of the rack toothed portion 710 of the rack shaft 631 in the circumferential direction, where the sheet member 792 and the rack shaft 631 come into contact by being pressed against each other, thereby lubricating between both sliding faces.

The steering gear device 603 configured in this way has the grease composition according to the present disclosure sealed therein, as the grease composition G. The grease composition according to the present disclosure ensures oil retention properties, and accordingly the steering gear device 603 has good seizure resistance and wear resistance.

<<Rolling Bearing>>

Figure 6:
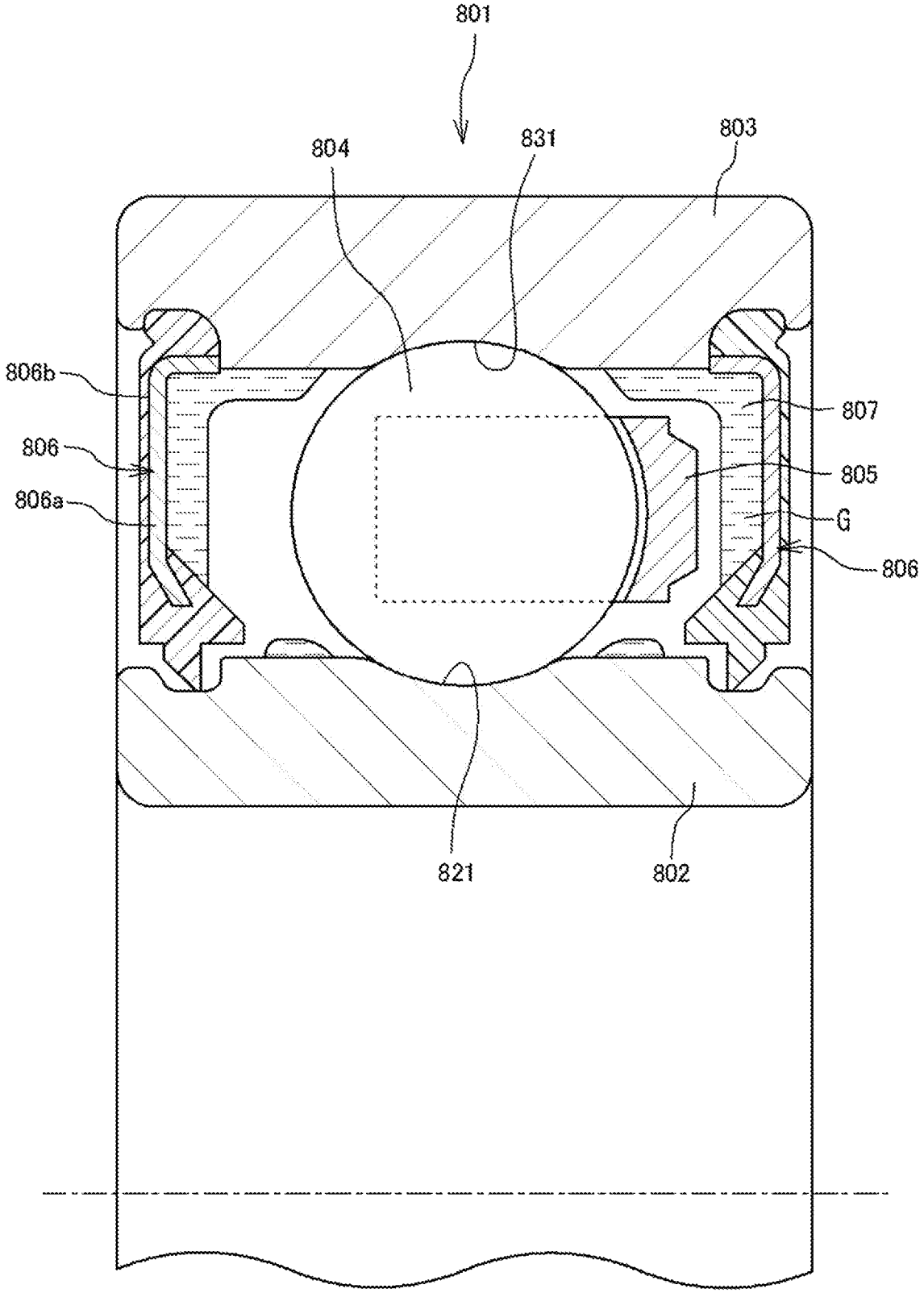
FIG. 6 is a cross-sectional view of a rolling bearing in which the grease composition is sealed.

FIG. 6 is a cross-sectional view of a ball bearing 801, which is an example of a rolling bearing.

The ball bearing 801 includes an inner ring 802, an outer ring 803 provided on an outer side of the inner ring 802 in a radial direction, balls 804 serving as a plurality of rolling elements provided between the inner ring 802 and the outer ring 803, and a cage 805 that is annular in shape and that holds these balls 804. Also, seals 806 are provided on each of one side and the other side in an axial direction of the ball bearing 801.

Further, the grease composition G is sealed in an annular region 807 between the inner ring 802 and the outer ring 803.

The inner ring 802 has an inner raceway face 821 formed on an outer periphery thereof, on which the balls 804 roll.

The outer ring 803 has an outer raceway face 831 formed on an inner periphery thereof, on which the balls 804 roll.

A plurality of the balls 804 is interposed between the inner raceway face 821 and the outer raceway face 831, and rolls on the inner raceway face 821 and the outer raceway face 831. The grease composition G sealed in the region 807 is also interposed at contact portions between the balls 804 and the inner raceway face 821 of the inner ring 802, and at contact portions between the balls 804 and the outer raceway face 831 of the outer ring 803. Note that the grease composition G is sealed in so as to occupy 20% by volume or more and 40% by volume or less of volume of a space surrounded by the inner ring 802, the outer ring 803, and the seals 806, excluding the balls 804 and the cage 805.

The seals 806 are members that are annular and that include a core 806*a* that is annular, and an elastic member 806*b* fixed to the core 806*a*, with a radial-direction outer-side portion fixed to the outer ring 803, and a radial-direction inner-side portion slidably attached onto the inner ring 802. The seals 806 prevent the grease composition G that is sealed in from externally leaking.

The ball bearing 801 configured in this way has the grease composition according to the present disclosure sealed therein as the grease composition G. The grease composition according to the present disclosure ensures oil retention properties, and accordingly the ball bearing 801 has good seizure resistance and wear resistance.

The grease composition according to the present disclosure can be sealed in and used with the above-described dual-pinion type electric power steering systems, column type electric power steering systems, rolling bearings, and so forth.

<<Grease Composition>>

The grease composition according to an embodiment of the present disclosure includes a base oil and a thickener, and the thickener includes a urea compound and a styrene-based polymer.

(Base Oil)

Examples of the base oil include poly-α-olefin (PAO), ester oil, polyalkylene glycol, fluorine oil, silicone oil, ether oil, and so forth.

Among these, poly-α-olefin (PAO) is preferred. This is because the above grease composition has good low-temperature fluidity by using poly-α-olefin. This is also because the grease composition exhibits little aggression with respect to members made of rubber or made of resin.

Examples of the poly-α-olefin include oligomerized or polymerized α-olefins such as 1-hexene, 1-octene, 1-nonene, 1-decene, 1-dodecene, and 1-tetradecene, or the like, and further hydrides thereof. As for the poly-α-olefin, PAO4 to PAO8, which are oligomerized 1-decene, are preferable.

The base oil kinematic viscosity of the base oil at 40° C. is preferably 20 $mm^2/s$ or more and 60 $mm^2/s$ or less. In this case, the grease composition is suitable for achieving low torque.

The base oil kinematic viscosity (40° C.) is more preferably 25 $mm^2/s$ or more and 50 $mm^2/s$ or less.

The above base oil kinematic viscosity is a value conforming to JIS K 2283.

(Thickener)

The thickener is a blended substance containing a urea compound and a styrene-based polymer. When the grease composition contains a thickener containing a urea compound and a styrene-based polymer, the grease composition has good oil retention properties and is suitable for ensuring low torque performance.

[Urea Compound]

Examples of the urea compound include urea compounds such as diurea, triurea, tetraurea, and polyurea (excluding diurea, triurea, and tetraurea), and so forth, urea/urethane compounds, urethane compounds such as diurethane and so forth, blended substances thereof, and so forth.

As for the urea compound, diurea represented by the following Structural Formula (1) is preferable, with regard to the point that the grease composition has good heat resistance.

$$R^1—NHCONH—R^2—NHCONH—R^3 \quad (1)$$

(In Formula (1), $R^1$ and $R^3$ represent amino residues, independently from each other, and $R^2$ represents a diisocyanate residue.)

Diurea represented by the above Structural Formula (1) is a reaction product of an amine compound and a diisocyanate compound.

The amine compound may be any one that is known to be an amine compound for synthesizing diurea, which is known as a thickener.

Examples of the amine compounds include alkylamines, alkylphenylamines, cyclohexylamines, and so forth.

Among these, alkylamines are preferred, with respect to the point that the grease composition has good low torque properties, and the point that the grease composition has good heat resistance.

The diisocyanate compound may be any diisocyanate compound that is known to be a diisocyanate compound for synthesizing diurea, which is known as a thickener.

Examples of the diisocyanate compound include 2,4-toluene diisocyanate (2,4-TDI), 2,6-toluene diisocyanate (2,6-TDI), a blended substance of 2,4-TDI and 2,6-TDI, 4,4'-diphenylmethane diisocyanate (MDI), and so forth.

The content of the thickener is preferably 10% by mass or more and 40% by mass or less as to the total amount of the base oil and the thickener.

The reason thereof is that the grease composition has good low torque properties.

In order to obtain the diurea represented by the above Structural Formula (1), reaction of the amine compound and the diisocyanate compound can be carried out under various conditions.

The above reaction may be carried out, for example, (a) in a base oil, or (b) in a solvent. When carried out in a base oil, the blended substance following the reaction can be used as the grease composition. When carried out in a solvent, the grease composition can be obtained by removing the solvent to obtain diurea in powder form, following which the diurea in powder form is blended with a base oil. A production method for the grease composition will be described in detail later.

[Styrene-Based Polymer]

The styrene-based polymer is a polymer containing styrene or a derivative thereof as a monomer component.

The styrene-based polymer may be a homopolymer of styrene or a derivative thereof, or a copolymer of a first monomer component selected from among styrene and derivatives thereof and another monomer component. The other monomer component may be styrene or a derivative thereof, as long as it is different from the first monomer component.

Examples of the copolymer include random copolymerization, alternating copolymerization, block copolymerization, and graft copolymers.

Examples of the styrene homopolymer include atactic polystyrene, isotactic polystyrene, poly-p-methylstyrene, poly-p-ethylstyrene, poly-p-isopropylstyrene, poly-α-methylstyrene, and so forth.

Examples of the copolymer include a copolymer of a first monomer component selected from styrene and derivatives thereof, and styrene or a derivative thereof other than the first monomer component.

Examples of the copolymer also include a copolymer of the first monomer component and an alkadiene. Examples of the alkadiene include butadiene, isoprene, pentadiene, hexadiene, and so forth.

The copolymer is preferably a styrene-isoprene copolymer.

In the above styrene-isoprene copolymer, the ratio (molar ratio) of styrene and isoprene can be styrene:isoprene=1:9 to 9:1.

The copolymer is not limited to a copolymer of two types of monomer components, and may be a copolymer of three or more types of monomer components.

The number average molecular weight of the styrene-based polymer is preferably 10,000 or more and 500,000 or less, and more preferably 20,000 or more and 200,000 or less. Measurement of the above number average molecular weight is performed using gel permeation chromatography.

Commercially available products can also be used for the styrene-based polymer. Specific examples of commercially available products include Lubrizol (registered trademark) 7306 (manufactured by The Lubrizol Corporation), 7308 of the same, 7460 of the same, Infineum (registered trademark) SV140 (manufactured by Infineum International Limited), 150 of the same, 160 of the same, Septon (registered trademark) 1001 (manufactured by Kuraray Co., Ltd.), 1020 of the same, and so forth.

The content of the styrene-based polymer is 2% by mass or more and 30% by mass or less as to the total amount of the urea compound and the styrene-based polymer.

When the content of the styrene-based polymer is less than 2% by mass, the grease composition has neither good oil retention properties nor good low torque properties. On the other hand, the oil retention properties of the grease composition will hardly improve even when the content thereof exceeds 30% by mass.

The content of the styrene-based polymer is preferably 2% by mass or more and 20% by mass or less as to the total amount of the urea compound and the styrene-based polymer, from the perspective of ensuring good oil retention properties and good low torque properties, and more preferably 2% by mass or more and 9% by mass or less.

In the above grease composition, the particles of the thickener that have diameters of 0.2 μm or more have an average value of diameter of 0.2 μm or more and 1.0 μm or less. The average value of the diameter of the thickener is the average value of the diameter calculated from the volume of the particles, assuming the shape of the particles of the thickener to be a true sphere.

The diameter of the particles of the thickener is measured using a confocal laser microscope using a laser beam with a wavelength of 488 nm as excitation light.

When observing the thickener using a confocal laser microscope, particles with a diameter of less than 0.2 μm cannot be observed, due to the resolution of the confocal laser microscope. Accordingly, in the grease composition of the present disclosure, the average value of the diameter of the thickener is defined as the average value of the diameter of the particles of the thickener with a diameter of 0.2 μm or more.

This does not mean that the above grease composition does not contain particles of thickener less than 0.2 μm in diameter.

When the above grease composition is irradiated with a laser beam having a wavelength of 488 nm, the urea compound making up the thickener emits fluorescence, and accordingly the urea compound is observed as a fluorescent image. Also, in the grease composition, the styrene-based polymer is present in a state of being entangled with the urea compound. Accordingly, in the grease composition of the present disclosure, the fluorescence image of the urea compound observed with a confocal laser microscope is regarded as being a fluorescence image of the thickener particles.

Also, in the above observation, the volume of the thickener particles is measured, the diameter of the thickener particles is calculated from the measured volume assuming the shape of the thickener particles to be a true sphere, and the average value thereof is calculated. The average value of the diameter can be calculated using commercially available analysis software.

The particles of the thickener that have diameters of 0.2 μm or more have an average value of diameter of 0.2 μm or more and 1.0 μm or less, thereby enabling both of ensuring oil retention properties and improving low torque performance.

When the average value of the diameter exceeds 1.0 μm, oil retention properties and low torque performance will deteriorate.

On the other hand, thickener particles with a diameter of less than 0.2 μm cannot be observed, as described above, and accordingly the lower limit of the average diameter is 0.2 μm.

The above grease composition may contain additives to the extent that the effects of the invention of the present disclosure are not impaired. Examples of the above additives include antioxidants, rust inhibitors, extreme pressure agents, anti-wear agents, dyes, hue stabilizers, viscosity improvers, structural stabilizers, metal deactivators, viscosity index improvers, and so forth.

When the grease composition contains additives, the total content of the additives in the grease composition is preferably 10% by mass or less as to the total mass of the base oil and the thickener.

As described above, the grease composition according to the present disclosure can be suitably used, for example, as a grease composition or the like that is sealed in gears such as electric power steering gears or the like of automobiles, rolling bearings, and so forth.

<<Production Method of Grease Composition>>

Methods of producing the grease composition according to the present disclosure that can be employed include (a) a method of synthesizing a urea compound in a solvent, and thereafter blending the obtained urea compound with a base oil (hereinafter also referred to as production method A), and (b) a method of synthesizing a urea compound in a base oil (hereinafter also referred to as production method B).

The urea compound can be synthesized by blending an amine compound and an isocyanate compound at a predetermined molar ratio, and causing reaction of the amine compound and the isocyanate compound. Production methods of the above grease composition will be described below by way of an example of a case in which a diisocyanate compound is used as the isocyanate compound, and diurea is synthesized as the urea compound.

(Production Method A)

As specific embodiments of production method A, for example, production methods A1 to A3 can be exemplified.

[Production Method A1]

Figure 7:
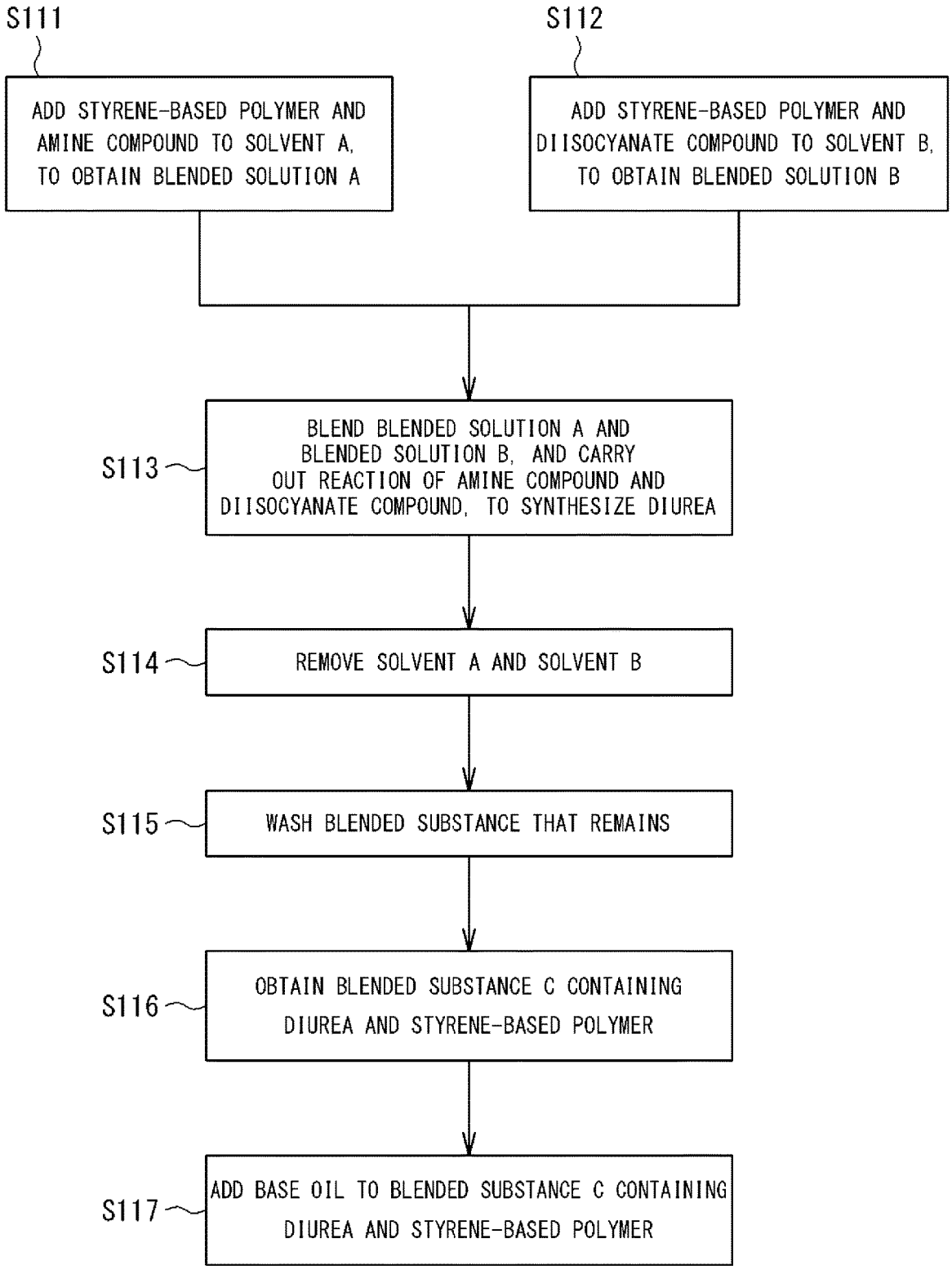
FIG. 7 is a flowchart for describing a production method A1 of a grease composition.

FIG. 7 is a flowchart for describing a production method A1 of the grease composition. (1) In production method A1, first, predetermined amounts of each of an amine compound, a diisocyanate compound, a styrene-based polymer, a solvent A, and a solvent B are provided. Specific examples of the amine compound, the diisocyanate compound, and the styrene-based polymer are as described above.

Preferably, each of the solvent A and the solvent B has a boiling point that is lower than that of the provided styrene-based polymer, and is capable of dissolving the styrene-based polymer that is provided.

Specific examples of the solvent A and the solvent B include toluene, hexane, ethyl acetate, tetrahydrofuran, p-xylene, m-xylene, o-xylene, methyl acetate and so forth. Note that it is preferable to avoid using substances that will react with substances having isocyanate groups, such as substances having amine groups, substances having hydroxyl groups, and so forth, or substances that will react with substances having amine groups, as the above solvent A and solvent B.

The solvent A and the solvent B preferably have a lower viscosity than the styrene-based polymer that is provided.

In the present disclosure, the viscosities of the solvents and the styrene-based polymer are measured using a Cannon-Fenske viscometer, in accordance with the method of JIS Z 8803:2011.

The solvent A and the solvent B may be the same or may be different, but are preferably the same.

When a blended solution A containing the solvent A and a blended solution B containing the solvent B are blended in a latter process, the two are blended in a sure manner, which is suitable for promoting the reaction between the amine compound and the diisocyanate compound. Moreover, when removing the solvent A and the solvent B in a subsequent process, selection of the removal method and removal conditions is facilitated.

(2) Next, a portion of the styrene-based polymer and the amine compound are added to the solvent A to obtain a blended solution A (S111).

At this time, the timing of adding the styrene-based polymer and the amine compound to the solvent A is not limited in particular, and (a) the styrene-based polymer may be dissolved in the solvent A to prepare a solution, following which the amine compound is dissolved or dispersed in the obtained solution, thereby yielding the blended solution A, (b) the amine compound may be dissolved or dispersed in the solvent A to prepare a blended solution, following which the styrene-based polymer is dissolved in the obtained blended solution, thereby yielding the blended solution A, or (c) the amine compound and the styrene-based polymer may be added to the solvent A at the same time, following which all the components are blended to yield the blended solution A.

At this time, the amount of the amine compound can be, for example, 5% by mass or more and 60% by mass or less as to 100% by mass of the solvent A.

Also, the amount of the styrene-based polymer can be, for example, 0.3% by mass or more and 30% by mass or less as to 100% by mass of the solvent A.

(3) Separately from the process of (2) above, the remaining styrene-based polymer and diisocyanate compound are added to the solvent B to obtain the blended solution B (S112).

At this time, the timing of adding the styrene-based polymer and the diisocyanate compound to the solvent B is not limited in particular, and (a) the styrene-based polymer may be dissolved in the solvent B to prepare a solution, following which the diisocyanate compound is dissolved or dispersed in the obtained solution, thereby yielding the blended solution B, (b) the diisocyanate compound may be dissolved or dispersed in solvent B to prepare a blended solution, following which the styrene-based polymer is dissolved in the obtained blended solution, thereby yielding the blended solution B, or (c) the diisocyanate compound and the styrene-based polymer may be added to the solvent B at the same time, following which all the components are blended to yield the blended solution B.

At this time, the amount of the diisocyanate compound can be, for example, 5% by mass or more and 60% by mass or less as to 100% by mass of the solvent B.

Also, the amount of the styrene-based polymer can be, for example, 0.3% by mass or more and 30% by mass or less as to 100% by mass of the solvent B.

(4) Next, the blended solution A and the blended solution B are blended, and reaction of the amine compound and the diisocyanate compound is carried out, so as to synthesize diurea (S113).

Here, the blended solution B may be added dropwise to the blended solution A while stirring the blended solution A, thereby blending the two, or the blended solution A may be added dropwise to the blended solution B while stirring the blended solution B, thereby blending the two.

The blended solution A and the blended solution B may be blended at room temperature or under heat.

When performing under heat, the heating temperature can be, for example, 40° C. or higher and 110° C. or lower.

The blended solution A and the blended solution B may be blended such that 1 mol of the diisocyanate compound is blended as to 2 to 2.2 mol of the amine compound.

The duration of reaction of the amine compound and the diisocyanate compound is not limited in particular, and may be any duration that allows the reaction to proceed sufficiently. Specifically, the duration may be, for example, 0.2 hours or more and 5 hours or less.

In the processes of (2) to (4) above, the blending of the amine compound, the diisocyanate compound, and the styrene-based polymer into their respective solvents, and the blending of the blended solution A and the blended solution B can be carried out using, for example, a mechanical stirrer, a magnet stirrer, or the like. Among these, a method using a mechanical stirrer is preferable due to facilitating uniform blending of each component.

Going through such processes of (1) to (4) enables a blended substance containing diurea, styrene-based polymer, and solvent A and solvent B, to be obtained.

(5) The solvent A and the solvent B are removed from the blended substance obtained in the process of (4) above (S114).

The method for removing the solvent A and the solvent B is not limited in particular, and the solvent A and the solvent B can be vaporized at room temperature, or while appropriately performing heating, pressure reduction, stirring, and so forth, as necessary. Specific methods can be selected as appropriate, depending on the types of the solvent A and the solvent B, and the following methods can be exemplified.

One example of a method is to let the blended substance stand at room temperature and atmospheric pressure to vaporize the solvent A and the solvent B.

Also, for example, another method that can be given is to heat the blended substance under atmospheric pressure at a temperature lower than the boiling points of the solvent A and the solvent B, to vaporize the solvent A and the solvent B. In this case, heating conditions that can be exemplified include performing heating under atmospheric pressure in a constant temperature bath at 40° C. for 5 hours or more and 10 hours or less, or the like, for example.

These methods may be combined.

(6) Next, the blended substance that remains after removing the solvent A and the solvent B is washed (S115).

Performing this washing process enables unreacted amine compounds and diisocyanate compounds remaining in the blended substance to be removed.

Specific examples of the cleaning method here include the following method, for example. First, the blended substance following the removal of the solvent A and the solvent B therefrom is blended with water, filtered with a membrane filter, and residue is collected. Thereafter, the residue is heated at a temperature lower than the boiling point of water, and lower than the boiling point of the styrene-based polymer, so as to vaporize water adhering to the residue, and thus remove water from the residue. In this case, heating conditions that can be exemplified include performing heating under atmospheric pressure in a high-temperature bath at 80° C. for 5 hours or more and 10 hours or less, or the like, for example.

(7) The blended substance that is washed is collected to obtain a blended substance C containing diurea and styrene-based polymer (S116).

The blended substance C that is obtained may be subjected to pulverization processing of diurea, as necessary. Performing the pulverization processing enables the thickener to be made finer and more uniform.

The above pulverization processing is preferably performed using a small-sized pulverizer (e.g., Labo Millser manufactured by Osaka Chemical Co., Ltd., or the like), because the pulverization processing can be performed with a simple device and at low costs.

(8) Next, base oil is added to the blended substance C containing diurea and styrene-based polymer, and the two are blended (S117).

Specific examples of the base oil are as described above.

Here, the blended substance C may be added dropwise to the base oil while stirring the base oil, to blend the two, or the base oil may be added dropwise to the blended substance C while stirring the blended substance C, to blend the two.

The blended substance C and the base oil are preferably blended under heat. At this time, the heating temperature may be, for example, 130° C. or higher and 180° C. or lower. The blending duration of the blended substance C and the base oil is not limited in particular, and may be, for example, 0.5 hours or more and 2 hours or less.

The method of blending the blended substance C and the base oil is not limited in particular, as long as both are blended uniformly, and examples thereof include a method using a mechanical stirrer or a magnetic stirrer, or the like. Among these, a method using a mechanical stirrer is preferable due to facilitating uniform blending of the two.

The above grease composition can be produced through such processes.

[Production Method A2]

Figure 8:
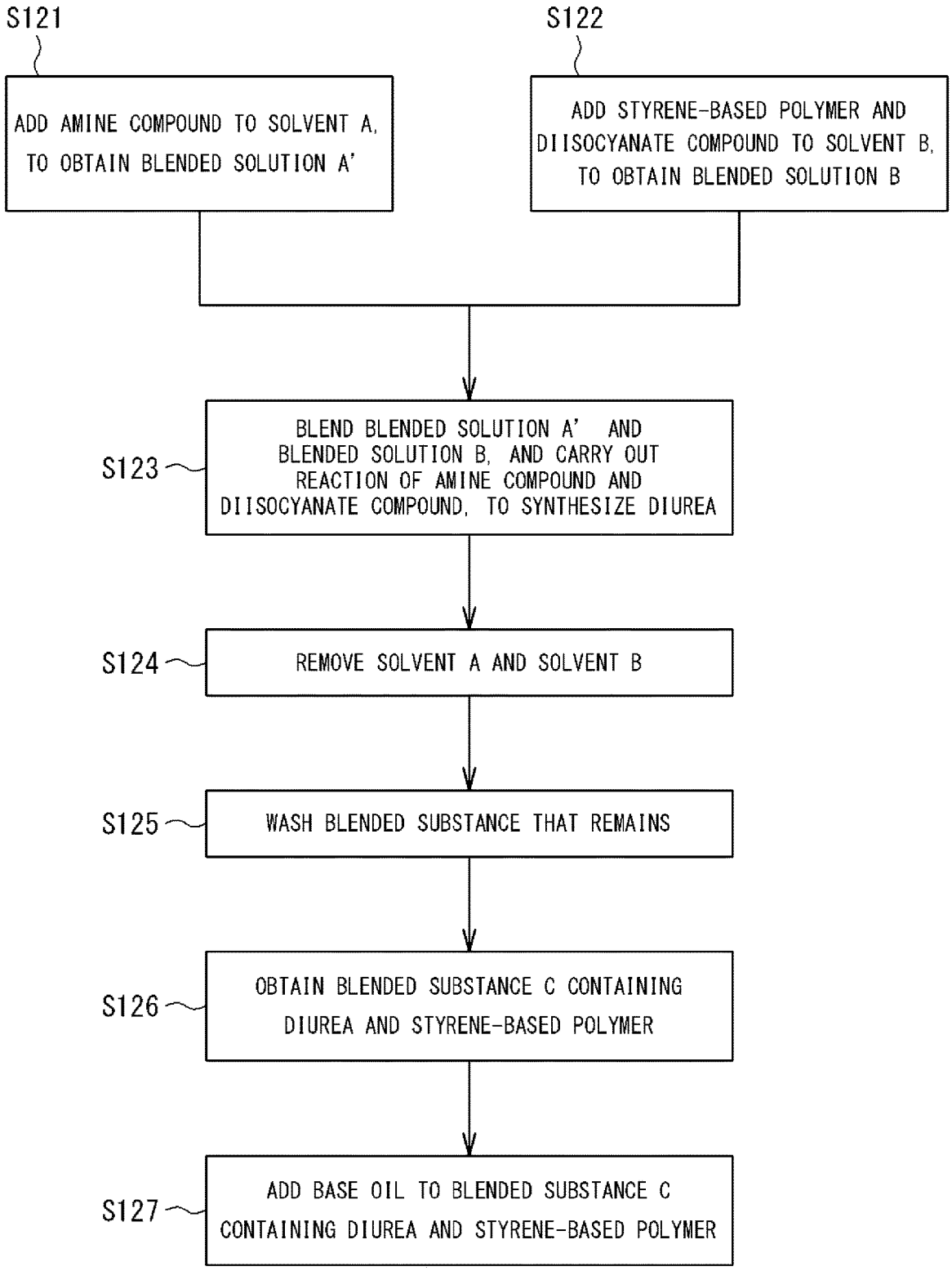
FIG. 8 is a flowchart for describing a production method A2 of a grease composition.

FIG. 8 is a flowchart for describing a production method A2 of the grease composition. (1) In production method A2, first, predetermined amounts of each of the amine compound, the diisocyanate compound, the styrene-based polymer, the solvent A, and the solvent B are provided.

Specific examples and suitable examples of the amine compound, the diisocyanate compound, and the styrene-based polymer are as described above.

Specific examples, preferred examples, and examples preferably avoided, regarding the solvent A and the solvent B, are the same as those for production method A1. The solvent A and the solvent B may be the same or may be different, but are preferably the same.

(2) Next, the amine compound is added to the solvent A to obtain a blended solution A' (S121).

At this time, the amount of the amine compound may be, for example, 5% by mass or more and 60% by mass or less as to 100% by mass of the solvent A.

(3) Separately from the process of (2) above, the styrene-based polymer and the diisocyanate compound are added to the solvent B to obtain the blended solution B (S122).

At this time, the timing of adding the styrene-based polymer and the diisocyanate compound to the solvent B is not limited in particular, and (a) the styrene-based polymer may be dissolved in the solvent B to prepare a solution, following which the diisocyanate compound is dissolved or dispersed in the obtained solution, thereby yielding the blended solution B, (b) the diisocyanate compound may be dissolved or dispersed in solvent B to prepare a blended solution, following which the styrene-based polymer is dissolved in the obtained blended solution, thereby yielding the blended solution B, or (c) the diisocyanate compound and the styrene-based polymer may be added to the solvent B at the same time, following which all the components are blended to yield the blended solution B.

At this time, the amount of the diisocyanate compound can be, for example, 5% by mass or more and 60% by mass or less as to 100% by mass of the solvent B.

Also, the amount of the styrene-based polymer can be, for example, 0.3% by mass or more and 30% by mass or less as to 100% by mass of the solvent B.

(4) Next, the blended solution A' and the blended solution B are blended, and reaction of the amine compound and the diisocyanate compound is carried out, so as to synthesize diurea (S123).

This process can be performed in the same way as the process of (4) in production method A1, except that the blended solution A is replaced with the blended solution A'.

In the processes of (2) to (4) above, the blending of the amine compound, the diisocyanate compound, and the styrene-based polymer into their respective solvents, and the blending of the blended solution A' and the blended solution B can be carried out using, for example, a mechanical stirrer, a magnet stirrer, or the like. Among these, a method using a mechanical stirrer is preferable due to facilitating uniform blending of each component.

Going through such processes of (1) to (4) enables a blended substance containing diurea, styrene-based polymer, and solvent A and solvent B, to be obtained.

(5) The solvent A and the solvent B are removed from the blended substance obtained in the process of (4) above (S124).

This process can be performed in the same way as the process of (5) in production method A1.

(6) Next, the blended substance that remains after removing the solvent A and the solvent B is washed (S125).

Performing this washing process enables unreacted amine compounds and diisocyanate compounds remaining in the blended substance to be removed.

This process can be performed in the same way as the process of (6) in production method A1.

(7) The blended substance that is washed is collected to obtain a blended substance C containing diurea and styrene-based polymer (S126).

The blended substance C that is obtained may be subjected to pulverization processing of diurea, as necessary. Performing the pulverization processing enables the thickener to be made finer and more uniform.

The above pulverization processing is preferably performed using a small-sized pulverizer (e.g., Labo Millser manufactured by Osaka Chemical Co., Ltd., or the like), because the pulverization processing can be performed with a simple device and at low costs.

(8) Next, base oil is added to the blended substance C containing diurea and styrene-based polymer, and the two are blended (S127).

Specific examples of the base oil are as described above.

The blended substance C and the base oil may be blended in the same way as in process of (8) in production method A1.

The above grease composition can be produced through such processes as well.

[Production Method A3]

Figure 9:
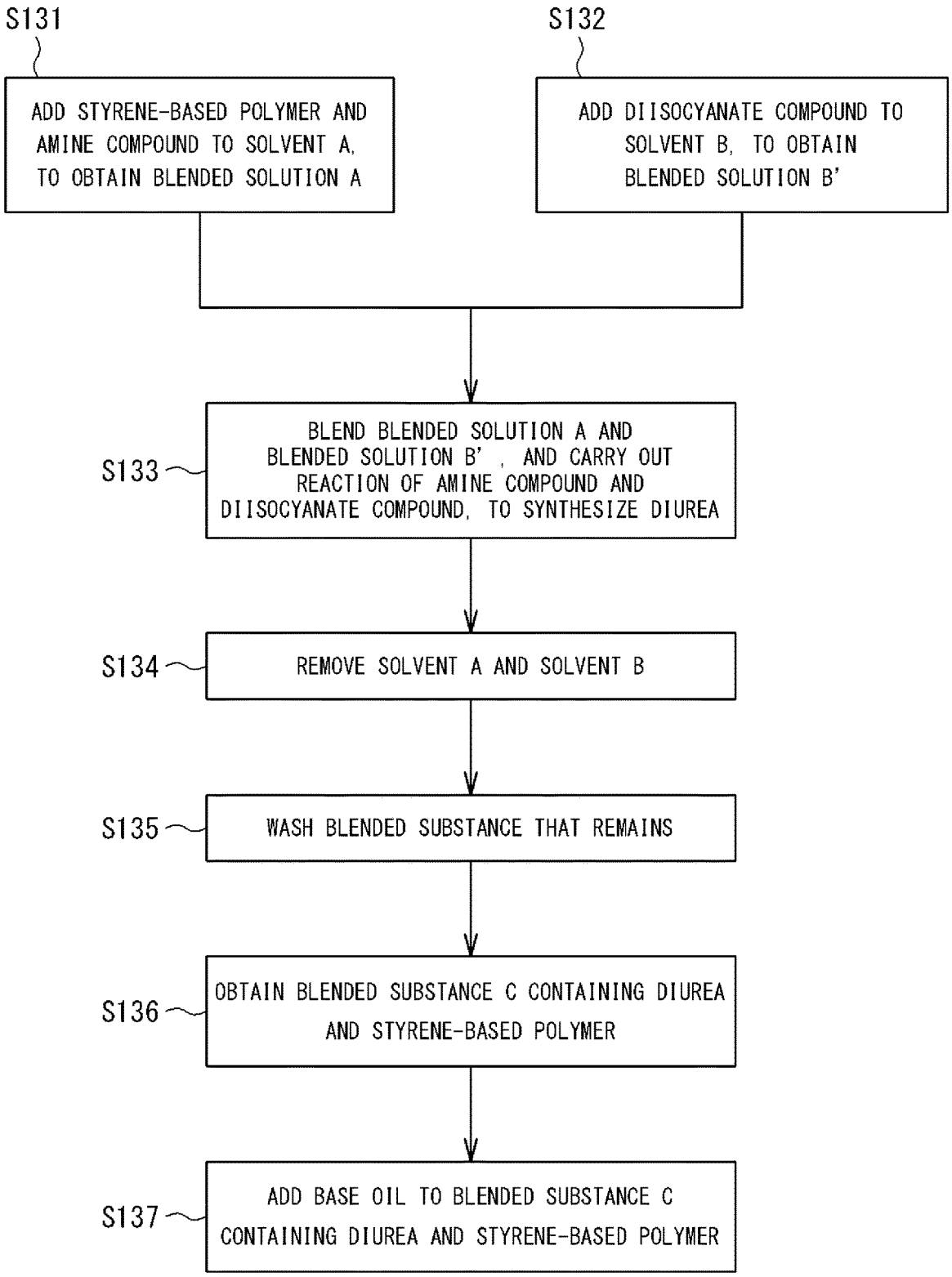
FIG. 9 is a flowchart for describing a production method A3 of a grease composition.

FIG. 9 is a flowchart for describing a production method A3 of the grease composition. (1) In production method A3, first, predetermined amounts of each of the amine compound, the diisocyanate compound, the styrene-based polymer, the solvent A, and the solvent B are provided.

Specific examples and suitable examples of the amine compound, the diisocyanate compound, and the styrene-based polymer are as described above.

Specific examples, preferred examples, and examples preferably avoided, regarding the solvent A and the solvent B, are the same as those for production method A1. The solvent A and the solvent B may be the same or may be different, but are preferably the same.

(2) Next, the styrene-based polymer and the amine compound are added to the solvent A to obtain a blended solution A (S131).

At this time, the timing of adding the styrene-based polymer and the amine compound to the solvent A is not limited in particular, and (a) the styrene-based polymer may be dissolved in the solvent A to prepare a solution, following which the amine compound is dissolved or dispersed in the obtained solution, thereby yielding the blended solution A, (b) the amine compound may be dissolved or dispersed in the solvent A to prepare a blended solution, following which the styrene-based polymer is dissolved in the obtained blended solution, thereby yielding the blended solution A, or (c) the amine compound and the styrene-based polymer may be added to the solvent A at the same time, following which all the components are blended to yield the blended solution A.

At this time, the amount of the amine compound may be, for example, 5% by mass or more and 60% by mass or less as to 100% by mass of the solvent A.

Also, the amount of the styrene-based polymer may be, for example, 0.3% by mass or more and 30% by mass or less as to 100% by mass of the solvent A.

(3) Separately from the process of (2) above, the diisocyanate compound is added to the solvent B to obtain a blended solution B' (S132).

At this time, the amount of the diisocyanate compound can be, for example, 5% by mass or more and 60% by mass or less as to 100% by mass of the solvent B.

(4) Next, the blended solution A and the blended solution B' are blended, and reaction of the amine compound and the diisocyanate compound is carried out, so as to synthesize diurea (S133).

This process can be performed in the same way as the process of (4) in production method A1, except that the blended solution B is replaced with the blended solution B'.

In the processes of (2) to (4) above, the blending of the amine compound, the diisocyanate compound, and the styrene-based polymer into their respective solvents, and the blending of the blended solution A and the blended solution B' can be carried out using, for example, a mechanical stirrer, a magnet stirrer, or the like. Among these, a method using a mechanical stirrer is preferable due to facilitating uniform blending of each component.

Going through such processes of (1) to (4) enables a blended substance containing diurea, styrene-based polymer, and solvent A and solvent B, to be obtained.

(5) The solvent A and the solvent B are removed from the blended substance obtained in the process of (4) above (S134).

This process can be performed in the same way as the process of (5) in production method A1.

(6) Next, the blended substance that remains after removing the solvent A and the solvent B is washed (S135).

Performing this washing process enables unreacted amine compounds and diisocyanate compounds remaining in the blended substance to be removed.

This process can be performed in the same way as the process of (6) in production method A1.

(7) The blended substance that is washed is collected to obtain a blended substance C containing diurea and styrene-based polymer (S136).

The blended substance C that is obtained may be subjected to pulverization processing of diurea, as necessary. Performing the pulverization processing enables the thickener to be made finer and more uniform.

The above pulverization processing is preferably performed using a small-sized pulverizer (e.g., Labo Millser manufactured by Osaka Chemical Co., Ltd., or the like), because the pulverization processing can be performed with a simple device and at low costs.

(8) Next, base oil is added to the blended substance C containing diurea and styrene-based polymer, and the two are blended (S137).

Specific examples of the base oil are as described above.

The blended substance C and the base oil may be blended in the same way as in process of (8) in production method A1.

The above grease composition can be produced through such processes as well.

[Modification of Production Method A]

In production methods A1 to A3, homogenization processing using a roll mill or the like may be performed as necessary, after blending the blended substance C and the base oil. Also, when producing a grease composition containing additives in addition to the blended substance C and the base oil, for example, necessary additives may be blended therein after blending the base oil and the blended substance C, or the blended substance C and the necessary additives may be blended into the base oil at the same time.

(c) The order of the process of removing the solvent A and the solvent B (S114, S124, S134) and the process of washing the blended substance (S115, S125, S135) may be reversed. In this case, for example, the following method, or the like, can be employed.

The above blended substance in which diurea is dispersed in the solvent A and the solvent B is placed in a separatory funnel, water is further placed in this separatory funnel, and unreacted amine compounds and unreacted diisocyanate compounds are transferred to the water phase. Next, the water containing the unreacted amine compounds and diisocyanate compounds is removed from the separatory funnel. Thereafter, the solvent A and the solvent B are removed from the above blended substance that has been washed using the separatory funnel, by the method of the process for removing the solvent A and the solvent B (S114, S124, S134).

The process of washing the blended substance (S115, S125, S135) is not an essential process, and may be omitted.

After performing the process of synthesizing diurea (S113, S123, S133), and before the process of removing the solvent A and the solvent B (S114, S124, S134), the base oil may also be added to the blended substance obtained in the process of synthesizing diurea. In this case, the process of adding the base oil to the blended substance C (S117, S127, S137) becomes unnecessary.

Production method A, which includes the process of synthesizing diurea in the presence of a styrene-based polymer, is suitable as a method for manufacturing a grease composition that has good oil retention properties and can ensure low torque performance.

(Production Method B)

As specific embodiments of production method B, for example, production methods B1 to B3 can be exemplified.

[Production Method B1]

Figure 10:
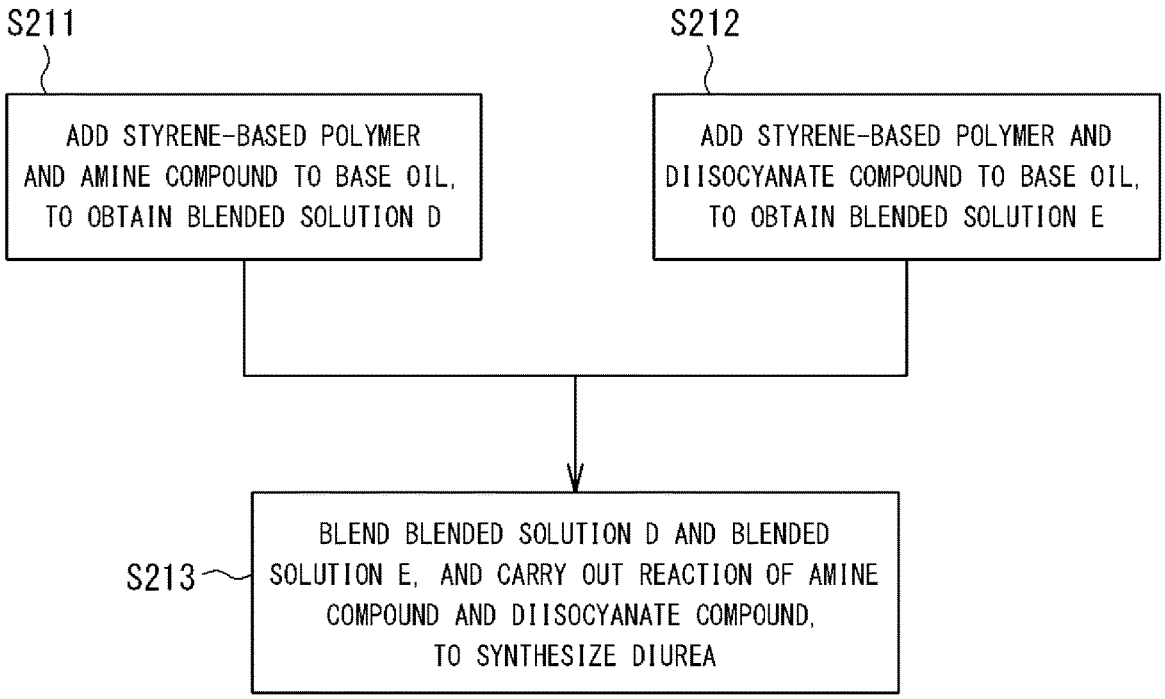
FIG. 10 is a flowchart for describing a production method B1 of a grease composition.

FIG. 10 is a flowchart for describing a production method B1 of the grease composition. (1) In production method B1, first, predetermined amounts of each of the amine compound, the diisocyanate compound, the styrene-based polymer, and the base oil are provided. Specific examples of each of the amine compound, the diisocyanate compound, the styrene-based polymer, and the base oil are as described above.

(2) Next, a portion of the styrene-based polymer and the amine compound are added to half of the base oil to obtain a blended solution D (S211).

At this time, the timing of adding the styrene-based polymer and the amine compound to the base oil is not limited in particular, and (a) the styrene-based polymer may be blended with the base oil, following which the amine compound is further blended in, (b) the amine compound may be blended with the base oil, following which the styrene-based polymer is further blended in, or (c) the amine compound and the styrene-based polymer may be added to the base oil at the same time, following which all the components are blended.

(3) The remaining styrene-based polymer and the diisocyanate compound are added to the remaining base oil to obtain a blended solution E (S212).

At this time, the timing of adding the styrene-based polymer and the diisocyanate compound to the base oil is not limited in particular, and (a) the styrene-based polymer may be blended with the base oil, following which the diisocyanate compound is further blended in, (b) the diisocyanate compound may be blended with the base oil, following which the styrene-based polymer is further blended in, or (c) the diisocyanate compound and the styrene-based polymer may be added to the base oil at the same time, following which all the components are blended.

(4) The blended solution D containing the amine compound and the blended solution E containing the diisocyanate compound are blended, and reaction of the amine compound and the diisocyanate compound is carried out so as to synthesize diurea (S213). Here, the blended solution E may be added dropwise to the blended solution D that is being stirred, thereby blending the two, or the blended solution D may be added dropwise to the blended solution E that is being stirred, thereby blending the two.

The blended solution D and the blended solution E may be blended at room temperature or under heat.

When performing under heat, the heating temperature can be, for example, 150° C. or higher and 180° C. or lower.

The blended solution D and the blended solution E may be blended such that 1 mol of the diisocyanate compound is blended as to 2 to 2.2 mol of the amine compound.

The duration of reaction of the amine compound and the diisocyanate compound is not limited in particular, and may be any duration that allows the reaction to proceed sufficiently. Specifically, the duration may be, for example, 0.5 hours or more and 2 hours or less.

In the processes of (2) to (4) above, the blending of the amine compound, the diisocyanate compound, and the styrene-based polymer into their respective base oils, and the blending of the blended solution D and the blended solution E can be carried out using, for example, a mechanical stirrer, a magnet stirrer, or the like. Among these, a method using a mechanical stirrer is preferable due to facilitating uniform blending of each component.

By going through the processes of (1) to (4), a grease composition containing diurea and styrene-based polymer in the base oil can be produced.

[Production Method B2]

Figure 11:
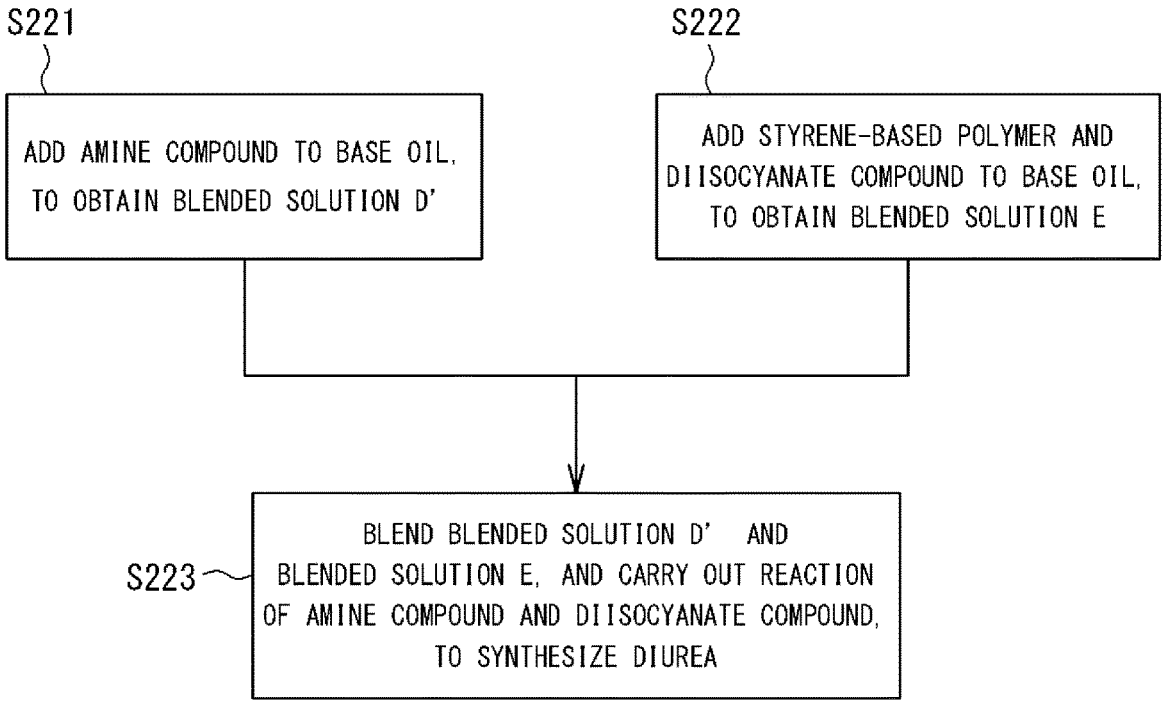
FIG. 11 is a flowchart for describing a production method B2 of a grease composition.

FIG. 11 is a flowchart for describing a production method B2 of the grease composition. (1) In production method B2, first, predetermined amounts of each of the amine compound, the diisocyanate compound, the styrene-based polymer, and the base oil are provided. Specific examples and suitable examples of each of the amine compound, the diisocyanate compound, the styrene-based polymer, and the base oil are as described above.

(2) The amine compound is added to half of the base oil, to obtain a blended solution D' (S221).

(3) The styrene-based polymer and the diisocyanate compound are added to the remaining base oil to obtain a blended solution E (S222).

At this time, the timing of adding the styrene-based polymer and the diisocyanate compound to the base oil is not limited in particular, and (a) the styrene-based polymer may be blended with the base oil, following which the diisocyanate compound is further blended in, (b) the diisocyanate compound may be blended with the base oil, following which the styrene-based polymer is further blended in, or (c) the diisocyanate compound and the styrene-based polymer may be added to the base oil at the same time, following which all the components are blended.

(4) The blended solution D' containing the amine compound and the blended solution E containing the diisocyanate compound are blended, and reaction of the amine compound and the diisocyanate compound is carried out so as to synthesize diurea (S223).

This process can be performed in the same way as the process of (4) in production method B1, except that the blended solution D is replaced with the blended solution D'.

In the processes of (2) to (4) above, the blending of the amine compound, the diisocyanate compound, and the styrene-based polymer into their respective base oils, and the blending of the blended solution D' and the blended solution E can be carried out using, for example, a mechanical stirrer, a magnet stirrer, or the like. Among these, a method using a mechanical stirrer is preferable due to facilitating uniform blending of each component.

A grease composition containing diurea and styrene-based polymer in the base oil can be produced by going through such processes of (1) to (4) as well.

[Production Method B3]

Figure 12:
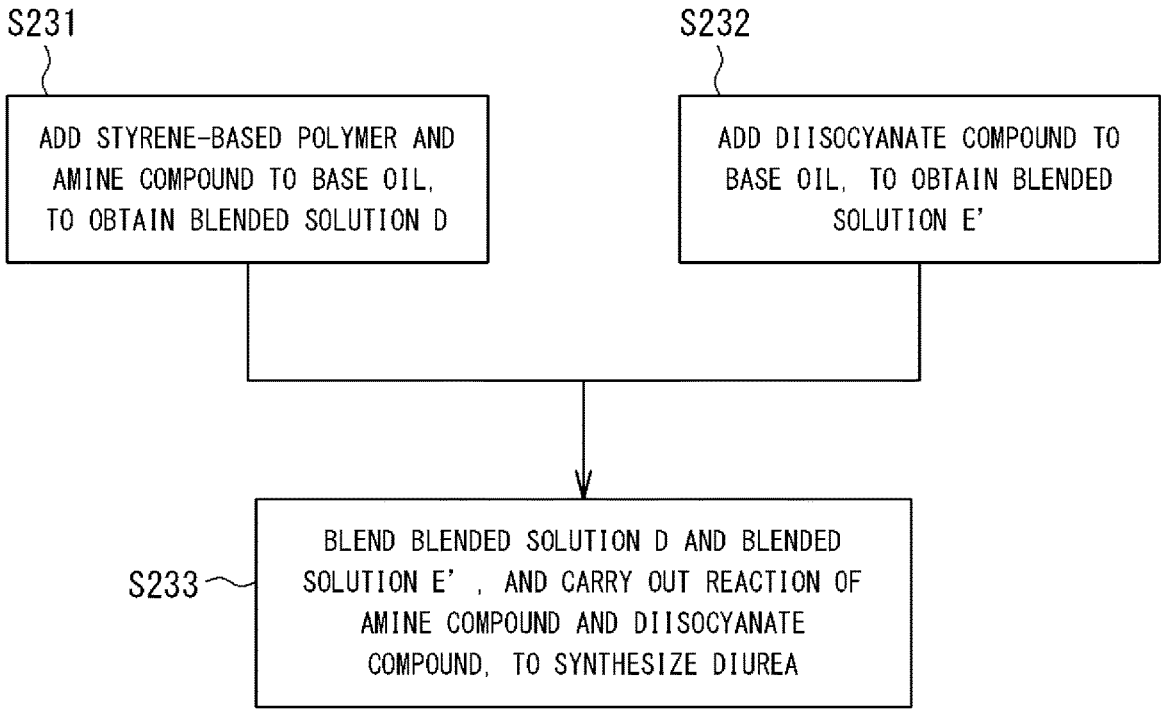
FIG. 12 is a flowchart for describing a production method B3 of a grease composition.

FIG. 12 is a flowchart for describing a production method B3 of the grease composition. (1) In production method B3, first, predetermined amounts of each of the amine compound, the diisocyanate compound, the styrene-based polymer, and the base oil are provided.

Specific examples and suitable examples of each of the amine compound, the diisocyanate compound, the styrene-based polymer, and the base oil are as described above.

(2) The styrene-based polymer and the amine compound are added to half of the base oil to obtain a blended solution D (S231).

At this time, the timing of adding the styrene-based polymer and the amine compound to the base oil is not limited in particular, and (a) the styrene-based polymer may be blended with the base oil, following which the amine compound is further blended in, (b) the amine compound may be blended with the base oil, following which the styrene-based polymer is further blended in, or (c) the amine compound and the styrene-based polymer may be added to the base oil at the same time, following which all the components are blended.

(3) The diisocyanate compound is added to the remaining base oil to obtain a blended solution E' (S232).

(4) The blended solution D containing the amine compound and the blended solution E' containing the diisocyanate compound are blended, and reaction of the amine compound and the diisocyanate compound is carried out so as to synthesize diurea (S233). This process can be performed in the same way as the process of (4) in production method B1, except that the blended solution E is replaced with the blended solution E'.

In the processes of (2) to (4) above, the blending of the amine compound, the diisocyanate compound, and the styrene-based polymer into their respective base oils, and the blending of the blended solution D and the blended solution E' can be carried out using, for example, a mechanical stirrer, a magnet stirrer, or the like. Among these, a method using a mechanical stirrer is preferable due to facilitating uniform blending of each component.

A grease composition containing diurea and styrene-based polymer in the base oil can be produced by going through such processes of (1) to (4) as well.

[Modification of Production Method B]

In production methods B1 to B3, homogenization processing using a roll mill or the like may be performed as necessary, after diurea is synthesized.

Also, when producing a grease composition containing additives in addition to the base oil, the diurea, and the styrene-based polymer, for example, necessary additives may be blended in following synthesizing of diurea.

In production method B1, the amount of styrene-based polymer mixed in the blended solution D and the amount of styrene-based polymer blended in the blended solution E may be the same or may be different.

In production methods B1 to B3, the amount of base oil to which the amine compound is added and the amount of base oil to which the isocyanate compound is added may be different.

In processes of (2) to (4) of production method B1, after preparing the blended solution D' in which the base oil is blended with the amine compound, and the blended solution E' in which the base oil is blended with the diisocyanate compound, the blended solution D', the blended solution E', and the styrene-based polymer may be blended.

Production method B, which includes the process of synthesizing diurea in the presence of such a styrene-based polymer, is also suitable as a method for manufacturing a grease composition that has good oil retention properties and can ensure low torque performance.

EXAMPLES

Next, the invention according to the present disclosure will be described in more detail based on Examples, but it should be noted that the invention according to the present disclosure is not limited to the Examples alone.

In the Examples/Comparative Examples, the following raw materials were used.

- Diisocyanate compound: 4,4'-diphenylmethane diisocyanate (MDI)
- Amine compound: octylamine
- Base oil: Poly-α-olefin: PAO8 (base oil kinematic viscosity of 46 $mm^2/s$ at 40° C.)
- Solvent: Toluene
- Styrene-based polymer: Styrene-isoprene copolymer (Lubrizol 7306, manufactured by The Lubrizol Corporation)
- Acrylic-based polymer: Alkyl methacrylate-based copolymer (ACLUBE V-1001, manufactured by Sanyo Chemical Industries, Ltd.)

Example 1

(1) A styrene-isoprene copolymer was dissolved in toluene. Further, a predetermined amount of octylamine was blended with the obtained solution to obtain a blended solution A1.

(2) Separately from the process of (1) above, a predetermined amount of MDI was blended into a solution of a styrene-isoprene copolymer dissolved in toluene to obtain a blended solution B1.

Now, the amount of styrene-isoprene copolymer added to obtain the blended solution A1 and the amount of styrene-isoprene copolymer added to obtain the blended solution B1 were set to be the same.

In the processes of (1) and (2), the amounts of the octylamine and the MDI were set to be such that the mixing ratio of the two (octylamine:MDI) was 2:1 in molar ratio, and the amount of diurea generated was an amount that was 40% by mass as to 100% by mass of the toluene.

Also, the amount of styrene-isoprene copolymer added was such that the amount of styrene-isoprene copolymer contained in a later-described blended substance C of diurea and styrene-isoprene copolymer was set to be 7.00% by mass as to the total amount of diurea and styrene-isoprene copolymer.

The blended solution A1 was prepared by adding the styrene-isoprene copolymer and the octylamine while stirring the toluene with a mechanical stirrer.

Also, the blended solution B1 was prepared by adding the styrene-isoprene copolymer and the MDI while stirring the toluene with a mechanical stirrer.

(3) The blended solution B1 was added dropwise to the blended solution A1 while stirring the blended solution A1 with a mechanical stirrer, thereby blending the two. After the dropwise addition of the blended solution B1 was completed, reaction of the octylamine and the MDI was carried out at room temperature while stirring for 0.5 hours to generate diurea.

(4) Thereafter, the blended substance containing diurea, styrene-isoprene copolymer, and toluene was left standing at room temperature for 24 hours, and the toluene was evaporated and removed, thereby producing the blended substance C of diurea and styrene-isoprene copolymer (thickener).

(5) The blended substance C at room temperature was added to the PAO8 as a base oil at room temperature, and heated to 150° C. while stirring with a mechanical stirrer. The base oil into which the blended substance C was blended was continuously stirred with a mechanical stirrer for 30 minutes, while maintained at 170° C. Thereafter, the blended substance was allowed to cool in still air to room temperature while stirring with the mechanical stirrer, and the stirring was then stopped.

At this time, the amount of the PAO8 (base oil) was set to be 70.00% by mass as to the total amount of the PAO8 and the blended substance C.

Thereafter, homogenization processing was performed using a roll mill, thus completing the grease composition.

The diurea generated in this example has the following Structural Formula.

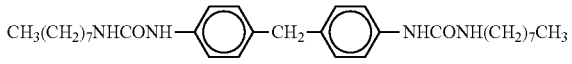

Example 2

A grease composition was completed in the same way as in Example 1, except for the amount of styrene-isoprene copolymer added being changed such that the amount of styrene-isoprene copolymer contained in the blended substance C was set to be 14.00% by mass as to the total amount of diurea and styrene-isoprene copolymer.

Comparative Example 1

A grease composition was completed in the same way as in Example 1, except for the amount of styrene-isoprene copolymer added being changed such that the amount of styrene-isoprene copolymer contained in the blended substance C was set to be 1.00% by mass as to the total amount of diurea and styrene-isoprene copolymer.

Comparative Example 2

(1) A predetermined amount of octylamine was blended with toluene to obtain a blended solution A2.

(2) Separately from the process of (1) above, a predetermined amount of MDI was blended with toluene to obtain a blended solution B2.

In the processes of (1) and (2), the amounts of the octylamine and the MDI were set to be such that the mixing ratio of the two (octylamine:MDI) was 2:1 in molar ratio, and the amount of diurea generated was an amount that was 40% by mass as to 100% by mass of the toluene.

The blended solution A2 was prepared by adding octylamine to toluene while stirring the toluene with a mechanical stirrer.

Also, the blended solution B1 was prepared by adding MDI to toluene while stirring the toluene with a mechanical stirrer.

(3) The blended solution B2 was added dropwise to the blended solution A2 while stirring the blended solution A2 with a mechanical stirrer, thereby blending the two. After the dropwise addition of the blended solution B2 was completed, reaction of the octylamine and the MDI was carried out at room temperature while stirring for 0.5 hours to generate diurea.

(4) Thereafter, the blended substance containing diurea and toluene was left standing at room temperature for 24 hours, and the toluene was evaporated and removed, thereby producing diurea (thickener).

(5) The room temperature diurea obtained in (4) was added to the PAO8 as a base oil at room temperature, and heated to 150° C. while stirring with a mechanical stirrer. The base oil into which the diurea was blended was continuously stirred with a mechanical stirrer for 30 minutes, while maintained at 170° C. Thereafter, the blended solution was allowed to cool in still air to room temperature while stirring with the mechanical stirrer, and the stirring was then stopped.

At this time, the amount of the PAO8 (base oil) was set to be 70.00% by mass as to the total amount of the PAO8 and the blended substance C.

Thereafter, homogenization processing was performed using a roll mill, thus completing the grease composition.

The Structural Formula of the diurea generated in the present Comparative Example 2 is the same as that in Example 1.

The grease composition produced in Comparative Example 2 does not contain styrene-isoprene copolymers.

Comparative Example 3

A grease composition was completed in the same way as in Example 1, except that an acrylic-based polymer (alkylmethacrylate-based copolymer) was mixed in instead of the styrene-isoprene copolymer.

Comparative Example 4

(1) Diurea was produced in the same way as in the processes of (1) to (4) in Comparative Example 2.

(2) The styrene-isoprene copolymer and the room temperature diurea obtained in (1) were added to the PAO8 (room temperature) as a base oil, and heated to 150° C. while stirring with a mechanical stirrer. The base oil blended with the styrene-isoprene copolymer and diurea was maintained at 170° C. and continued to be stirred with the mechanical stirrer for 30 minutes. Thereafter, the blended solution was allowed to cool in still air to room temperature while stirring with the mechanical stirrer, and the stirring was then stopped.

At this time, the amount of the PAO8 (base oil) was set to be 70.00% by mass as to the total amount of the PAO8, the styrene-isoprene copolymer, and the diurea. The amount of the styrene-isoprene copolymer was set to be 7.00% by mass as to the total amount of the styrene-isoprene copolymer and diurea.

Thereafter, homogenization processing was performed using a roll mill, thus completing the grease composition.

Example 3

(1) PAO8 was used as a base oil, and this base oil was heated to 100° C.

(2) The base oil, the styrene-isoprene copolymer, the octylamine, and the 4,4'-diphenylmethane diisocyanate (MDI) were measured. The amounts of the octylamine and the MDI were measured so that the mixing ratio of the two (octylamine:MDI) was 2:1 in molar ratio.

Now, the amount of base oil was set to be an amount that was 85.00% by mass as to the total amount of the PAO8 and the thickener (styrene-isoprene copolymer and diurea generated through a later process).

Also, the amount of the styrene-isoprene copolymer was set to be 7.00% by mass as to the total amount of the styrene-isoprene copolymer and the diurea that was generated.

(3) Half of the base oil (100° C.), half of the styrene-isoprene copolymer, and the octylamine were placed in a stainless steel container A, and the blended substance was stirred at 100° C. for 30 minutes to obtain a blended solution D1.

(4) Into another stainless steel container B were placed the remaining half of the base oil (100° C.), the remaining half of the styrene-isoprene copolymer, and the MDI, and stirred at 100° C. for 30 minutes, thereby obtaining a blended solution E1.

(5) The blended solution D1 containing octylamine in the stainless steel container A was added dropwise into the stainless steel container B, and gradually introduced into the blended solution E1 containing the MDI.

(6) After confirming that the entire amount of the blended solution D1 in the stainless steel container A was introduced into the stainless steel container B, the temperature was raised to 170° C.

(7) Stirring was performed while heating, and the temperature was maintained at 170° C. for 30 minutes.

(8) The heating was stopped, and the blended solution was allowed to cool in still air to 100° C., while stirring.

(9) After confirming that the temperature was no higher than 100° C., stirring was stopped and the blended solution was allowed to cool in still air, in that state, to room temperature.

(10) Homogenization processing was performed using a roll mill, thereby completing a grease composition.

Comparative Example 5

(1) PAO8 was used as a base oil, and this base oil was heated to 100° C.

(2) The base oil, the octylamine, and the 4,4'-diphenylmethane diisocyanate (MDI) were measured. The amounts of the octylamine and the MDI were measured so that the mixing ratio of the two (octylamine:MDI) was 2:1 in molar ratio.

Now, the amount of base oil was set to be an amount that was 85.00% by mass as to the total amount of the PAO8 and the thickener (diurea generated through a later process).

(3) Half of the base oil (100° C.) and the octylamine were placed in a stainless steel container A, and stirred at 100° C. for 30 minutes to obtain a blended solution D2.

(4) Into another stainless steel container B were placed the remaining half of the base oil (100° C.) and the MDI, and stirred at 100° C. for 30 minutes, thereby obtaining a blended solution E2.

(5) The blended solution D2 containing octylamine in the stainless steel container A was added dropwise into the stainless steel container B, and gradually introduced into the blended solution E2 containing the MDI.

(6) After confirming that the entire amount of the blended solution D2 in the stainless steel container A was introduced into the stainless steel container B, the temperature was raised to 170° C.

(7) Stirring was performed while heating, and the temperature was maintained at 170° C. for 30 minutes.

(8) The heating was stopped, and the blended solution was allowed to cool in still air to 100° C., while stirring.

(9) After confirming that the temperature was no higher than 100° C., stirring was stopped and the blended solution was allowed to cool in still air, in that state, to room temperature.

(10) Homogenization processing was performed using a roll mill, thereby completing a grease composition.

The grease composition produced in Comparative Example 5 does not contain a styrene-isoprene copolymer.

Comparative Example 6

(1) A composition containing a base oil and diurea was obtained in the same way as in the processes of (1) to (9) of Comparative Example 5.

(2) A styrene-isoprene copolymer dissolved in a solvent (toluene) was added to the composition obtained in (1), and stirred at room temperature, in that state, for 30 minutes. At this time, the amount of the styrene-isoprene copolymer was set to be 7.00% by mass as to the total amount of the styrene-isoprene copolymer and diurea.

(3) Stirring was performed while heating, and the temperature was maintained at 100° C. for 30 minutes to evaporate and remove the toluene.

Thereafter, homogenization processing was performed using a roll mill, thus completing the grease composition.

The grease compositions produced in the Examples and the Comparative Examples were evaluated as follows. The results are shown in Table 3.

1. Worked Penetration (60W)

The worked penetration (60W) of the grease compositions produced in the Examples and the Comparative Examples was measured by a method conforming to JIS K 2220.

2. Oil Separation Degree

The oil separation degree of the grease compositions produced in the Examples and the Comparative Examples (excluding the grease compositions of Comparative Examples 4 and 6) was measured using a method conforming to JIS K 222011. The results are shown in Table 1.

At this time, the sample amount was 10 g, the test temperature was 150° C., and the test duration was 24 hours. The number of samples was 2, and the average value thereof was used as the evaluation result.

3. Bearing Running Torque

The bearing running torque of the grease compositions prepared in the Examples and the Comparative Examples (excluding the grease compositions of Comparative Examples 3, 4, and 6) was measured using a running torque tester under conditions shown in Table 1 below. Now, the grease compositions made in the Examples and the Comparative Examples were each applied to a test bearing, which was a 62022RUCM (with non-contact seals on both sides), with the balls and the cage removed from the space surrounded by the inner ring, the outer ring, and the seals, into which space the grease composition was filled in so as to be 35% by volume as to the volume of the space.

This test bearing was installed in a test machine and rotated at 1800 $min^{-1}$ for 30 minutes, and the average value of the torque during the final one minute was taken as the bearing running torque. The number of samples was 2, and the average value thereof was used as the evaluation result.

Note that in this evaluation, a running torque of 12 mN·m or less is considered to have good low torque properties, and 10 mN·m or less is considered to have even better low torque properties.

TABLE 2

| | |
|---|---|
| Equipment used | Confocal laser microscope TCS SP08 (Manufactured by Leica Microsystems) |
| Laser wavelength (intensity) | 488 nm (2.9%) |
| Microscope | Inverted fluorescence microscope DMi8 |
| Objective lens | HC PL APO CS2 (63 × 1.40 OIL) |

TABLE 3

| Synthesis of diurea | | | Example 1 | Example 2 | Comparative Example 1 | Comparative Example 2 | Comparative Example 3 | Comparative Example 4 | Example 3 | Comparative Example 5 | Comparative Example 6 |
|---|---|---|---|---|---|---|---|---|---|---|---|
| | | | In solvent (in toluene) | | | | | | In base oil | | |
| Base oil | PAO8 | % by mass | 70.00 | 70.00 | 70.00 | 70.00 | 70.00 | 70.00 | 85.00 | 85.00 | 85.00 |
| | Thickener | % by mass | 30.00 | 30.00 | 30.00 | 30.00 | 30.00 | 30.00 | 15.00 | 15.00 | 15.00 |
| | Diurea (octylamine/MDI) | % by mass | 27.90 | 25.80 | 29.70 | 30.00 | 27.90 | 27.90 | 13.95 | 15.00 | 13.95 |
| | Styrene-based polymer | % by mass | 2.10 | 4.20 | 0.30 | 0.00 | 0.00 | 2.10 | 1.05 | 0.00 | 1.05 |
| | Acrylic-based polymer | % by mass | 0.00 | 0.00 | 0.00 | 0.00 | 2.10 | 0.00 | 0.00 | 0.00 | 0.00 |
| Proportion of styrene-based polymer or acrylic-based polymer in thickener | | % by mass | 7.00 | 14.00 | 1.00 | 0.00 | 7.00 | 7.00 | 7.00 | 0.00 | 7.00 |
| Worked penetration | | | 262 | 254 | 236 | 265 | 245 | 265 | 250 | 246 | 246 |
| Oil separation degree | | % by mass | 0.0 | 0.0 | 1.1 | 0.9 | 1.8 | ND | 0.0 | 1.8 | ND |
| Running torque | | mN · m | 9.8 | 6.7 | 20.6 | 20.0 | ND | ND | 9.6 | 17.2 | ND |
| Average value of diameter of thickener | | μm | 0.6 | 0.4 | 1.5 | 1.5 | 3.4 | 1.3 | 0.7 | 4.6 | 4.5 |

TABLE 1

| | Conditions |
|---|---|
| Testing Equipment | Inner ring rotating torque testing machine |
| Bearing number of tested bearing | 6202 2RUCM |
| Amount of grease sealed in | 35% of spatial volume |
| Axial load | 44N |
| Rotational speed | 1800 $min^{-1}$ |
| Testing temperature | Room temperature |
| Test Duration | 30 min |
| Number of samples | 2 |
| Measurement item | Bearing running torque (average value from 29 to 30 min) |

4. Measurement of Average Particle Size of Thickener

The average particle size of the thickener contained in the grease compositions prepared in the Examples and the Comparative Examples was measured using a confocal laser microscope (TCS SP08, manufactured by Leica Microsystems). At this time, the configuration of the confocal laser microscope shown in Table 2 was employed. This device has built-in software (Leica Application Suite X (LAS X) Version 4.4.0) that can calculate the average particle size of observed objects. Using this software enables calculation of the volume of the thickener for each particle from a three-dimensional image that is acquired, calculation of the diameter of each particle assuming that the shape of each particle is a true sphere, and calculation of the average value of the diameter of each particle as a measured value (average particle size).

The average values of the diameters of the thickeners that were obtained are shown in Table 3.

According to the results shown in Table 3, in the thickener contained in the grease composition according to the embodiment of the present disclosure, the particles of the thickener that have diameters of 0.2 μm or more have an average value of diameter of 0.2 μm or more and 1.0 μm or less. It was also revealed that the above grease composition has a low oil separation degree (0.2% or less) and good oil retention properties. It was also revealed that the above grease composition has good low torque properties.

DESCRIPTION OF THE REFERENCE NUMERALS

1 Dual-pinion type electric power steering system
2 Steering shaft
3 Steering gear device
33 Housing
31 Rack shaft
310 First rack toothed portion
311 First rack teeth
312 Cylindrical face
313 Cylindrical face
314 Second rack toothed portion
315 Second rack teeth
32 First pinion shaft
320 First pinion toothed portion
321 First pinion tooth
392 First sheet member
54 Second pinion shaft
540 Second pinion toothed portion
541 Second pinion teeth
592 Second sheet member
601 Column type electric power steering system
602 Steering shaft
603 Steering gear device
633 Housing

631 Rack shaft
710 Rack toothed portion
711 Rack teeth
712 Cylindrical face
632 Pinion shaft
720 Pinion toothed portion
721 Pinion teeth
792 Sheet member
801 Ball bearing
802 Inner ring
803 Outer ring
804 Balls
805 Cage
806 Seal
G grease composition

The invention claimed is:

1. A method of producing a grease composition, comprising:

providing a styrene-based polymer, an amine compound, an isocyanate compound, a lubricating oil, a first solvent that does not dissolve a urea compound that is generated, and a second solvent that does not dissolve the urea compound that is generated; wherein a content of the styrene-based polymer is 2% by mass or more and 30% by mass or less relative to a total amount of the urea compound and the styrene-based polymer;

dissolving or dispersing the amine compound in the first solvent, dissolving or dispersing the isocyanate compound in the second solvent, dissolving or dispersing the styrene-based polymer in one or both of the first solvent and the second solvent, such that a first blended solution containing at least the amine compound and a second blended solution containing at least the isocyanate compound are prepared;

blending the first blended solution and the second blended solution, and carrying out reaction of the amine compound and the isocyanate compound, such that a third blended solution containing the styrene-based polymer and the urea compound is generated; and adding the lubricating oil after removing the first solvent and the second solvent from the third blended solution.

* * * * *